US011059687B2

(12) United States Patent
Sakamoto et al.

(10) Patent No.: US 11,059,687 B2
(45) Date of Patent: Jul. 13, 2021

(54) SHEET SUPPLYING DEVICE

(71) Applicant: RISO KAGAKU CORPORATION, Tokyo (JP)

(72) Inventors: Masayoshi Sakamoto, Ibaraki (JP); Yoshihisa Morita, Ibaraki (JP); Naoya Masuda, Ibaraki (JP); Toru Sakabe, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 7 days.

(21) Appl. No.: 16/175,115

(22) Filed: Oct. 30, 2018

(65) Prior Publication Data

US 2019/0127163 A1 May 2, 2019

(30) Foreign Application Priority Data

Oct. 31, 2017 (JP) ..... JP2017-210194
Mar. 30, 2018 (JP) ..... JP2018-068520
Jul. 30, 2018 (JP) ..... JP2018-142184

(51) Int. Cl.

*B65H 3/48* (2006.01)
*B65H 3/54* (2006.01)
*B65H 3/12* (2006.01)
*B65H 1/08* (2006.01)
*B65H 3/14* (2006.01)

(Continued)

(52) U.S. Cl.

CPC ..... *B65H 3/48* (2013.01); *B65H 1/08* (2013.01); *B65H 3/128* (2013.01); *B65H 3/14* (2013.01); *B65H 3/54* (2013.01); *B65H 5/224* (2013.01); *B65H 7/02* (2013.01);

(Continued)

(58) Field of Classification Search

CPC ... B65H 1/14; B65H 7/00; B65H 7/02; B65H 7/14; B65H 7/16; B65H 7/18; B65H 3/047; B65H 3/12; B65H 3/124; B65H 3/128; B65H 3/14; B65H 3/48; B65H 2405/1142;

(Continued)

(56) References Cited

U.S. PATENT DOCUMENTS 4,364,550 A * 12/1982 Hynes ..... B65H 3/14 271/11
5,108,083 A 4/1992 Russel et al.

(Continued)

FOREIGN PATENT DOCUMENTS

CN 101075106 A 11/2007
CN 206375447 U 8/2017

(Continued)

OTHER PUBLICATIONS

Mar. 29, 2019 Extended European Search Report in corresponding European Application No. 18203671.5.

(Continued)

*Primary Examiner* — Prasad V Gokhale
(74) *Attorney, Agent, or Firm* — Greenblum & Bernstein, P.L.C.

(57) ABSTRACT

A sheet supplying device includes: an air blow opening configured to blow air to a side portion of an uppermost part of stacked sheets; and a flow adjuster extending from above the air blow opening over an edge of a top sheet of the stacked sheets and configured to cause an air flow blown from the air blow opening to travel along an upper surface of the top sheet of the stacked sheets.

18 Claims, 13 Drawing Sheets

(51) Int. Cl.
*B65H 5/22* (2006.01)
*B65H 7/02* (2006.01)

(52) U.S. Cl.
CPC ..... *B65H 2405/113* (2013.01); *B65H 2405/1142* (2013.01); *B65H 2406/1222* (2013.01); *B65H 2406/14* (2013.01)

(58) Field of Classification Search
CPC ..... B65H 2406/121; B65H 2406/1222; B65H 2406/14; B65H 2406/323
See application file for complete search history.

(56) References Cited

U.S. PATENT DOCUMENTS 6,015,144 A * 1/2000 Yoshii ..... B65H 3/48 271/97
6,352,255 B1 * 3/2002 Taylor ..... B65H 3/0816 271/104
6,745,694 B1 6/2004 Ellis et al.
8,132,806 B2 * 3/2012 Fuda ..... B65H 7/02 271/98
8,205,872 B2 * 6/2012 Yamauchi ..... B65H 7/14 271/98
8,210,518 B2 * 7/2012 Suzuki ..... B65H 3/48 271/97
8,366,101 B2 2/2013 Morita
10,384,890 B2 * 8/2019 Matsuoka ..... G03G 15/6511
2007/0262513 A1 * 11/2007 Fukusaka ..... B65H 3/48 271/98
2008/0297580 A1 * 12/2008 Fukumoto ..... B65H 3/60 347/104
2010/0148419 A1 * 6/2010 Suzuki ..... B65H 3/48 271/3.11
2016/0107854 A1 * 4/2016 Hashimoto ..... B65H 3/48 271/11
2018/0194578 A1 * 7/2018 Nakamura ..... B65H 29/245

FOREIGN PATENT DOCUMENTS

JP 4492429 B2 4/2010
JP 2012-131614 A 7/2012

OTHER PUBLICATIONS

Dec. 16, 2019 Chinese Office Action in Chinese Patent Application No. 201811289699.2.

* cited by examiner

SHEET SUPPLYING DEVICE

CROSS REFERENCE TO RELATED APPLICATION

This application is based upon and claims the benefit of priority from the prior Japanese Patent Application Nos. 2017-210194 filed on Oct. 31, 2017, 2018-068520 filed on Mar. 30, 2018 and 2018-142184 filed on Jul. 30, 2018, the entire contents of which are incorporated herein by reference.

BACKGROUND

1. Technical Field

The disclosure relates to a sheet supplying device which sends out sheets stacked on a paper feed tray at an uppermost part one by one.

2. Related Art

A sheet feed device which sends out sheets stacked on a sheet feed tray at an uppermost part one by one is known. The sheet feed device sends multiple sheets laid one on top of the other to an image forming apparatus when a burr formed at an edge of the top sheet in cutting is caught by the next sheet or the sheets adhere to each other by static electricity, and the sheets then cause jamming in the image forming apparatus in some cases.

It is conceivable to cause air to blow from lateral sides to an uppermost part of the stacked sheets and cause air to flow between the top sheet and the next sheet to separate the sheets from each other. Japanese Patent No. 4492429 proposes a device which opens and closes a shutter to intermittently cause air to blow sheets and repeatedly lift and drop the sheets of an uppermost part of stacked sheets, thereby improving an effect of separating the top sheet and the next sheet from each other.

Moreover, Japanese Patent Application Publication No. 2012-131614 proposes a sheet feed device which includes: a leading end abutting portion having a leading end contact surface which comes into contact with conveyance direction leading ends of sheets P housed in a sheet housing portion; and lifting prevention members which are provided at an upstream side in the conveyance direction of the sheets P and at lateral sides of a suction conveyor and which come into contact with the sheet P lifted by air flows from blow portions configured to cause the air flows for lifting the sheet to blow from side surfaces opposed in a direction orthogonal to the conveyance direction of the sheets P housed in the sheet housing portion and prevent lifting of a portion of the sheet P in contact with the lift prevention member.

SUMMARY

In order to cause the image forming apparatus to sufficiently exhibit its print processing performance, it is important to supply the sheets to the image forming apparatus at a pace matching the print processing performance of the image forming apparatus.

Moreover, in order to send out the sheets to the image forming apparatus from the top one by one, the top sheet and the second sheet need to be appropriately separated from each other.

The disclosure is directed to a sheet supplying device which can surely lift the stacked top sheet and separate the top sheet from the second sheet.

A sheet supplying device in accordance with some embodiments includes: an air blow opening configured to blow air to a side portion of an uppermost part of stacked sheets; and a flow adjuster extending from above the air blow opening over an edge of a top sheet of the stacked sheets and configured to cause an air flow blown from the air blow opening to travel along an upper surface of the top sheet of the stacked sheets.

In the aforementioned configuration, the flow adjuster and the air flow blown to the uppermost part of the stacked sheets from the side can surely lift the top sheet. The sheets can be surely sent out one by one with the top sheet and the next sheet separated from each other.

The air blow opening may include: a lift air blow opening configured to blow air from a side of the uppermost part of the stacked sheets to lift the sheets; and a first separation air blow opening configured to blow air from the side of the uppermost part of the stacked sheets and a second separation air blow opening configured to blow air from a downstream side of the uppermost part of the stacked sheets in a conveyance direction, the first separation air blow opening and the second separation air blow opening configured to separate the sheets from one another by blowing of the air. The sheet supplying device may further include an air controller configured to control execution and stop of blowing of air from the lift air blow opening, control execution and stop of blowing of air from the first separation air blow opening, and control execution and stop of blowing of air from the second separation air blow opening. The flow adjuster may extend from above the lift air blow opening and the first separation air blow opening over the edge of the top sheet of the stacked sheets and may be configured to cause an air flow blown from the lift air blow opening to travel along the upper surface of the stacked top sheet. The air controller may be configured to: cause air to blow from the lift air blow opening and generate the air flow along the upper surface of the stacked top sheet; after the air flow generated from the air blown from the lift air blow opening lifts the stacked top sheet to the flow adjuster, stop the blowing of air from the lift air blow opening while the top sheet is sucked by a suction conveyor; and while stopping the blowing of air from the lift air blow opening, cause air to blow from the first separation air blow opening and the second separation air blow opening to between the top sheet lifted up to the flow adjuster and a second top sheet to separate the top sheet and the second top sheet from each other.

In the aforementioned configuration, the flow adjuster and the air flow blown to the uppermost part of the stacked sheets from the side can surely lift the top sheet. Moreover, the sheets can be surely sent out one by one with the lifted top sheet and the next sheet surely separated from each other.

DETAILED DESCRIPTION

Figure 1:
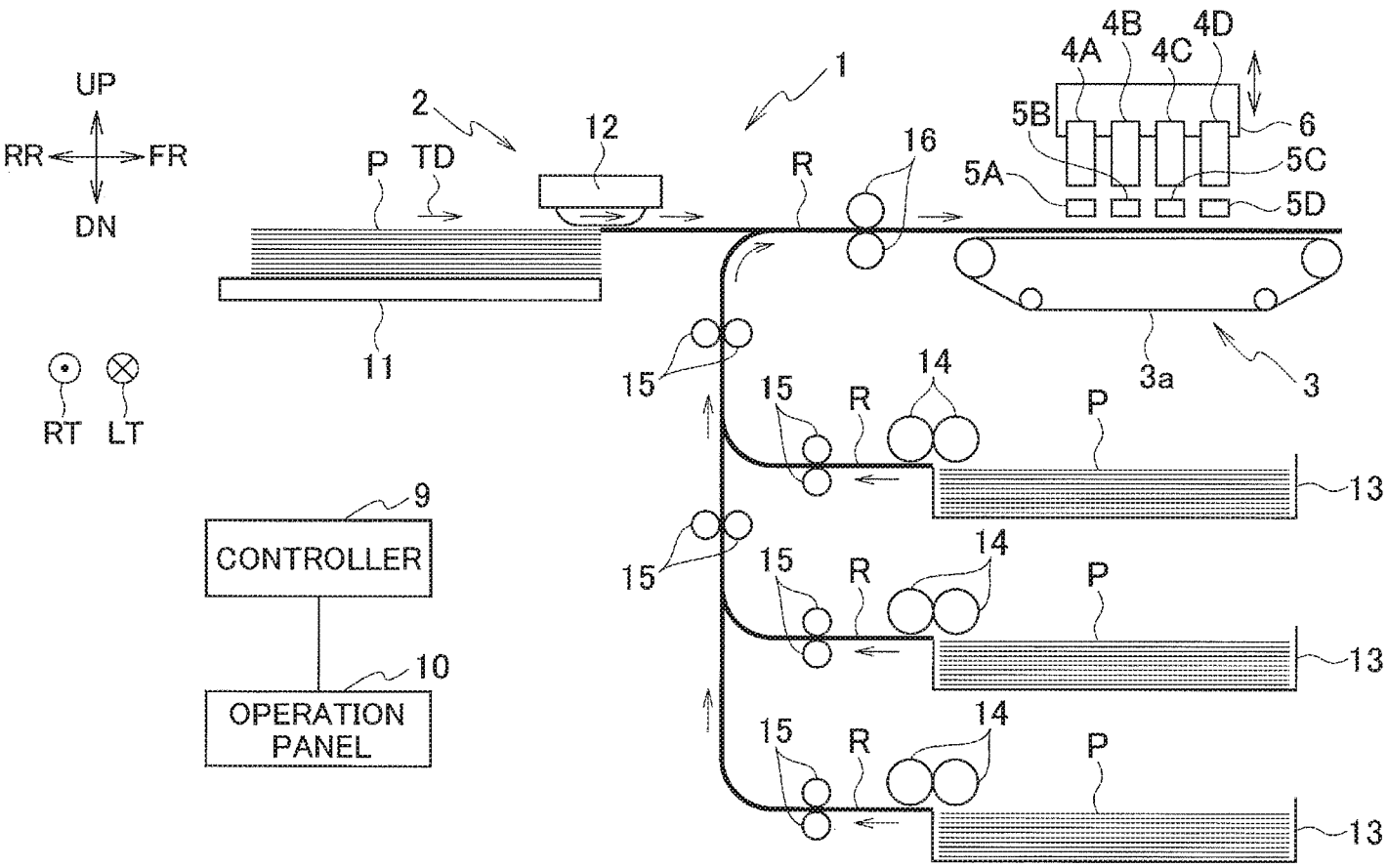
FIG. 1 is an explanatory view illustrating a schematic configuration of a main portion of an inkjet recording apparatus in which a sheet feed device according to a first embodiment of the present invention is mounted.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

FIG. 1 is an explanatory view illustrating a schematic configuration of a main portion of an inkjet recording apparatus 1 in which a sheet feed device 20 according to a first embodiment of the present invention is mounted. Note that the inkjet recording apparatus 1 illustrated in FIG. 1 is assumed to be an inkjet line color printer but the type of the apparatus is not limited to this.

Moreover, in the following description, a direction orthogonal to the sheet surface of FIG. 1 is referred to as left-right direction and a direction from the sheet surface toward the viewer is referred to as right. Furthermore, up and down in the sheet surface of FIG. 1 is referred to as up-down direction and the horizontal direction in the sheet surface of FIG. 1 is referred to as front-rear direction. Note that directions toward right and left of the sheet surface are referred to as front and rear, respectively. Moreover, a route illustrated by bold lines in FIG. 1 is a conveyance route R through which, for example, sheets P being print media are conveyed. Upstream and downstream in the following description mean upstream and downstream in the conveyance route R. In FIGS. 1 to 7C, right, left, up, down, front, rear, and a conveyance direction are denoted by RT, LT, UP, DN, FR, RR, and TD, respectively.

As illustrated in FIG. 1, the inkjet recording apparatus 1 of the first embodiment includes a sheet feeder 2, a printer 3, a controller 9, and an operation panel 10.

The sheet feeder 2 feeds sheets P to the printer 3. The sheet feeder 2 includes an external sheet feed tray 11, an external sheet feed unit 12, multiple internal sheet feed trays 13, multiple pairs of internal sheet feed rollers 14, multiple pairs of internal sheet feed conveyance rollers 15, and registration rollers 16.

The sheets P to be used in printing are stacked on the external sheet feed tray 11. The external sheet feed tray 11 is installed to be partially exposed to the outside of a housing (not illustrated) of the inkjet recording apparatus 1.

The external sheet feed unit 12 picks up the sheets P from the external sheet feed tray 11 one by one and conveys the sheets P to the registration rollers 16 along the conveyance route R. The external sheet feed unit 12 conveys the sheets P in a circulation direction of a belt 12*a* rotationally driven by a not-illustrated motor, to the conveyance route R in front of the external sheet feed unit 12 while sucking the sheets P by means of air suction from suction holes (not illustrated) provided in a belt 12*a*.

The sheets P to be used in printing are stacked on the internal sheet feed trays 13. The internal sheet feed trays 13 are arranged inside the housing (not illustrated) of the inkjet recording apparatus 1.

The internal sheet feed rollers 14 pick up the sheets P from the internal sheet feed trays 13 one by one and sends the sheets P to the conveyance route R. The internal sheet feed rollers 14 are rotationally driven by a not-illustrated motor.

The internal sheet feed conveyance rollers 15 convey the sheets P picked up from the internal sheet feed trays 13 to the registration rollers 16. The internal sheet feed conveyance rollers 15 are arranged between the internal sheet feed rollers 14 and the registration rollers 16, along the conveyance route R. The internal sheet feed conveyance rollers 15 are rotationally driven by a not-illustrated motor.

The registration rollers 16 temporarily stop each of the sheets P conveyed from the external sheet feed unit 12 or the internal sheet feed conveyance rollers 15 and then convey the sheet P to the printer 3. The registration rollers 16 are arranged downstream of the external sheet feed unit 12 and the internal sheet feed conveyance rollers 15. The registration rollers 16 are rotationally driven by a not-illustrated motor.

The printer 3 includes a belt platen portion 3*a* and four inkjet heads 4A to 4D which correspond respectively to colors of CKMY.

The belt platen portion 3*a* conveys the sheets P fed from the sheet feeder 2 while sucking and holding the sheets P on a belt. The belt platen portion 3*a* is arranged downstream of the registration rollers 16.

The inkjet heads 4A to 4D print images on the sheets P conveyed by the belt platen portion 3*a* by ejecting color inks corresponding to the respective inkjet heads 4A to 4D to the conveyed sheets P. The inkjet heads 4A to 4D are arranged above the belt platen portion 3*a*.

A head gap adjuster 6 can move the inkjet heads 4A to 4D in the up-down direction. The head gap adjuster 6 can adjust a gap (head gap) between the inkjet heads 4A to 4D and the sheet P conveyed by the belt platen portion 3*a* by lifting and lowering the inkjet heads 4A to 4D.

Cleaners 5A to 5D corresponding to the respective inkjet heads 4A to 4D are provided below the inkjet heads 4A to 4D. The cleaners 5A to 5D receive the inks discharged by the inkjet heads 4A to 4D in a purging operation for cleaning.

The cleaners 5A to 5D wipe the nozzle surfaces of the inkjet heads 4A to 4D to remove the inks discharged by the inkjet heads 4A to 4D in the purging operation and remaining on the nozzle surfaces.

A print job from the outside is inputted into the controller 9. The operation panel 10 is connected to the controller 9. Various pieces of information relating to printing such as, for example, information on specifications (sheet size, sheet type, and the like) of the sheets P stacked on the external sheet feed tray 11 and the internal sheet feed trays 13 of the sheet feeder 2 and information on an environment (temperature, humidity, and the like) of a location where the inkjet recording apparatus 1 is installed are inputted on the operation panel 10 by a user as necessary.

The controller 9 supplies the sheets P in the external sheet feed tray 11 and the internal sheet feed trays 13 to the printer 3 and causes the printer 3 to print images on the sheets P based on print setting information in the inputted print job and the information inputted on the operation panel 10.

Next, a schematic configuration of the sheet feed device 20 according to the first embodiment which is applied to the external sheet feed tray 11 is described with reference to the explanatory view of FIG. 2.

Figure 2:
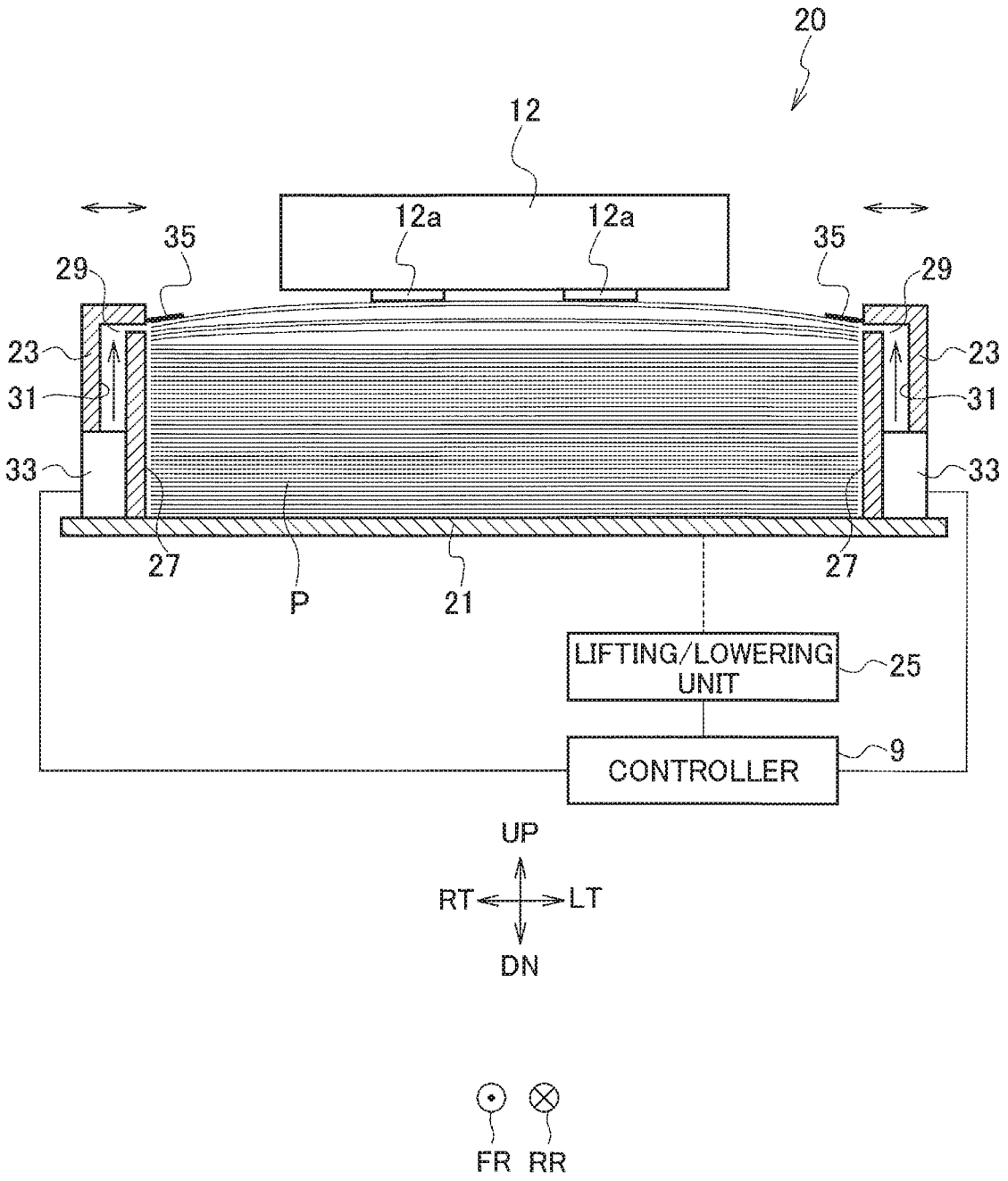
FIG. 2 is an explanatory view illustrating the sheet feed device according to the first embodiment which is applied to an external sheet feed tray in FIG. 1.
Figure 3:
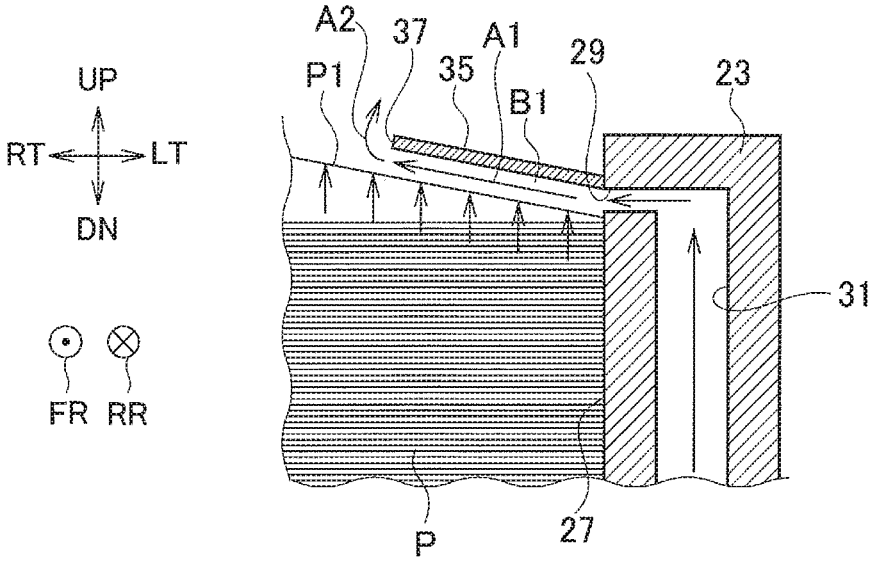
FIG. 3 is an explanatory view illustrating a phenomenon occurring to the uppermost part of sheets stacked on the sheet feed device of FIG. 2 when air blows from an air blow opening to the uppermost part of the sheets.
Figure 4:
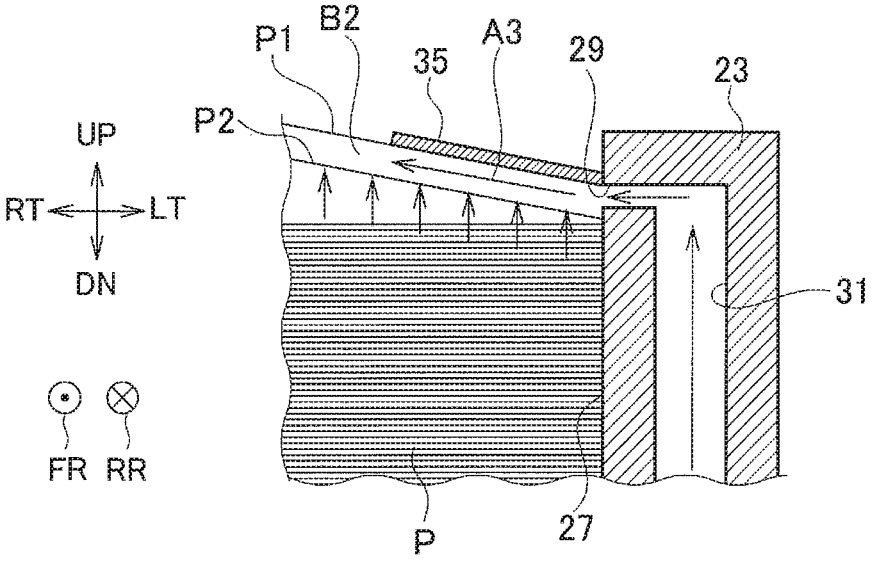
FIG. 4 is an explanatory view illustrating a phenomenon occurring to the uppermost part the sheets stacked on the sheet feed device of FIG. 2 when air blows from the air blow opening to the uppermost part of the sheets.

As illustrated in FIG. 2, the sheet feed device 20 (sheet supplying device) applied to the external sheet feed tray 11 of FIG. 1 includes a sheet feed tray 21 on which the sheets P are stacked and placed and a pair of guides 23 which are provided to stand respectively at left and right ends of the sheet feed tray 21. FIG. 2 illustrates a state where the sheet feed device 20 is viewed from a main body side (printer 3 side) of the inkjet recording apparatus 1 in FIG. 1.

The sheet feed tray 21 is lifted and lowered in the up-down direction by a lifting/lowering unit 25 depending on an increase and a decrease in the number of stacked sheets P. Lifting and lowering the sheet feed tray 21 with the lifting/lowering unit 25 allows the position of the top sheet P stacked on the sheet feed tray 21 to be maintained at a height where the belt 12*a* of the external sheet feed unit 12 can suck the sheet P.

The guides 23 come into contact respectively with left and right portions of each sheet P stacked on the sheet feed tray 21 and restrict movement of the sheet P in the left-right direction. The guides 23 are configured to be movable in the left-right direction relative to the sheet feed tray 21 depending on the size (sheet width) of the sheets P.

An air blow opening 29 facing a side of an uppermost part of the sheets P stacked on the sheet feed tray 21 (for example, including top sheet P1) is formed at an upper end of an inner wall surface 27 of each guide 23 coming into contact with the sheets P. The air blow opening 29 communicates with an air flow passage 31 formed inside the guide 23 and a fan 33 housed in the guide 23 is connected to the air flow passage 31.

The air blow opening 29 is formed to have a smaller flow passage cross-sectional area than that of the air flow passage 31. Accordingly, the flow velocity of air supplied from the fan 33 to the air flow passage 31 increases due to a squeezing effect when the air passes the air blow opening 29.

A flow adjuster 35 is attached to an upper edge of the air blow opening 29. As illustrated in the explanatory view of FIG. 3, for example, the flow adjuster 35 is provided to protrude slightly upward relative to the horizontal direction from the upper edge of the air blow opening 29 and extends above a left or right edge (of the surface) of the sheet P (top sheet P1) stacked on the sheet feed tray 21. The flow adjuster 35 may be a plate, for example.

In the sheet feed device 20 configured as described above, a jet of air blowing from the air blow opening 29 becomes an air flow A1 flowing along a lower surface of the flow adjuster 35 facing an upper surface of the top sheet P1 stacked on the sheet feed tray 21, due to the Coandă effect.

The air flow A1 flowing along the lower surface of the flow adjuster 35 travels toward a front end 37 of the flow adjuster 35 while entraining air present in a gap B1 between the top sheet P on the sheet feed tray 21 and the flow adjuster 35 due to the nature of the jet. The air flow A1 reaching the front end 37 of the flow adjuster 35 becomes an air flow A2 moving away from the stacked sheets P due to a diffraction effect occurring at the front end 37 of the flow adjuster 35.

Accordingly, the gap B1 between the top sheet P1 stacked on the sheet feed tray 21 and the flow adjuster 35 extending over the edge of the sheet P1 is set to a negative pressure state and the edge of the top sheet P1 is sucked toward the flow adjuster 35. Thus, as illustrated in the explanatory view of FIG. 4, a gap B2 is formed between the top sheet P1 whose edge is sucked toward the flow adjuster 35 and the second (second top) sheet P2 from the top which is stacked on the sheet feed tray 21. As described above, the flow adjuster 35 can cause the top sheet P1 stacked on the sheet feed tray 21 to be surely lifted and separated from the second sheet P2.

Then, the air blowing from the air blow opening 29 flows through the gap B2 formed between the top sheet P1 sucked toward the flow adjuster 35 and the second sheet P2 from the top. An air flow A3 flowing through the gap B2 between the sheets P1, P2 provides lift to the top sheet P1 sucked toward the flow adjuster 35 and maintains the top sheet P1 in a state lifted to a point where the edge of the sheet P1 comes into contact with the flow adjuster 35.

Moreover, when the air blowing from the air blow opening 29 flows through the gap B2 between the top sheet P1 and the second sheet P2 from the top, the air becomes the air flow A3 flowing along a lower surface of the top sheet P1 due to the Coandă effect. The air flow A3 flows out toward sides of the sheets P stacked on the sheet feed tray 21 while entraining air present in the gap B2 between the sheets P1, P2 due to the nature of the jet. Accordingly, the gap B2 between the sheets P1, P2 is set to a negative pressure state and the second sheet P2 is sucked toward the lifted top sheet P1.

Figure 5:
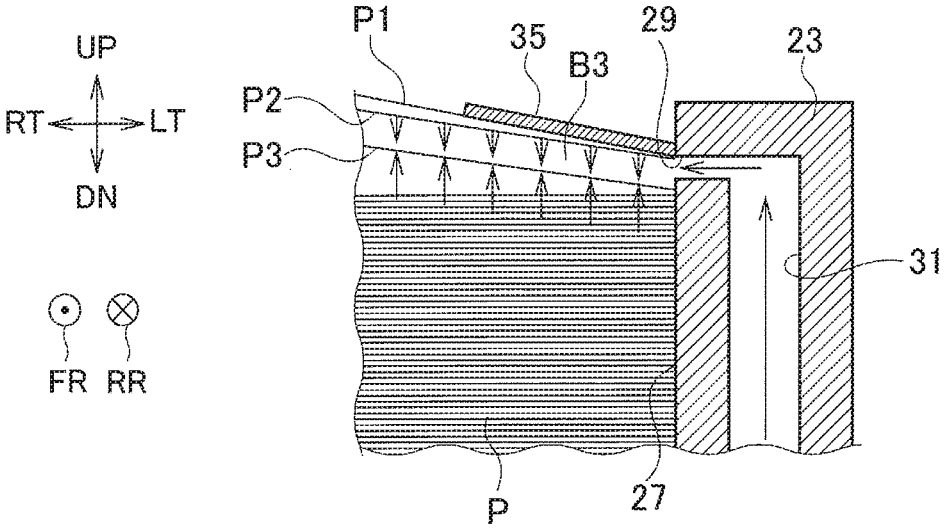
FIG. 5 is an explanatory view illustrating a phenomenon occurring to the uppermost part of the sheets stacked on the sheet feed device of FIG. 2 when air blows from the air blow opening to the uppermost part of the sheets.

As illustrated in the explanatory view of FIG. 5, a gap B3 is formed between the second sheet P2 from the top which is sucked toward the top sheet P1 and the third sheet P3 from the top which is stacked on the sheet feed tray 21. Then, the air blowing from the air blow opening 29 flows through the gap B3 formed between the second sheet P2 from the top which is sucked toward the top sheet P1 and the third sheet P3.

Then, an air flow flowing through the gap B3 between the sheets P2, P3 provides lift to the second sheet P2 from the top which is sucked toward the top sheet P1.

Moreover, when the air blowing from the air blow opening 29 flows through the gap B3 between the sheets P2, P3, the air becomes the air flow flowing along a lower surface of the second sheet P2 from the top due to the Coandă effect. This air flow flows out toward the sides of the sheets P stacked on the sheet feed tray 21 while entraining air present in the gap B3 between the sheets P2, P3 due to the nature of the jet. Accordingly, the gap B3 between the sheets P2, P3 is set to a negative pressure state.

In this case, the gap B2 between the top sheet P1 and the second sheet P2 from the top spreads over the entire surfaces of the sheets P1, P2. The volume of the gap B2 is larger than the volume of the gap B1 (FIG. 3) formed between the edge of the top sheet P1 and the flow adjuster 35 by the air flow A1 from the air blow opening 29.

Accordingly, as the air flow A3 flows through the gap B2 between the top sheet P1 and the second sheet P2 from the top, the flow velocity of the air flow A3 decreases to a velocity lower than that of the air flow A1 flowing along the lower surface of the flow adjuster 35. In other words, the intensity of the jet of the air flow A3 is smaller than that of the air flow A1. Thus, a lower negative pressure than a negative pressure generated in the gap B1 (FIG. 3) formed between the edge of the top sheet P1 and the flow adjuster 35 by the air flow A1 from the air blow opening 29 is generated in the gap B3 between the sheets P2, P3.

Hence, the suction force sucking the second sheet P2 toward the top sheet P1 is smaller than the suction force sucking the edge of the top sheet P1 toward the flow adjuster 35 (FIG. 4) and the lift amount of the second sheet P2 is smaller than the lift amount of the top sheet P1.

Thus, the flow rate of the air flow flowing through the gap B3 between the second sheet P2 sucked toward the top sheet P1 and the third sheet P3 stacked on the sheet feed tray 21 is lower than the flow rate of the air flow A3 flowing through the gap B2 (FIG. 4) formed between the top sheet P1 sucked toward the flow adjuster 35 and the second sheet P2 from the top.

Accordingly, the lift provided to the second sheet P2 by the air flowing through the gap B3 between the second sheet P2 and the third sheet P3 stacked on the sheet feed tray 21 is smaller than the lift provided to the top sheet P1 by the air flow A3 flowing through the gap B2 (FIG. 4) formed between the top sheet P1 and the second sheet P2 from the top. Thus, the second sheet P2 sucked toward the top sheet P1 drops toward the third sheet P3 stacked on the sheet feed tray 21 in the middle of the suction toward the top sheet P1, due to the weight of the second sheet P2 itself or turbulence in the air flow flowing through the gap B3.

Thereafter, the second sheet P2 is repeatedly lifted and dropped in the aforementioned process and moves up and down between the top sheet P1 lifted to the point where the edge comes into contact with the flow adjuster 35 and the third sheet P3 stacked on the sheet feed tray 21. In other words, the second sheet P2 moves up and down in a short cycle between top sheet P1 and the third sheet P3 stacked on the sheet feed tray 21 by an action which involves no operation of a mechanical element.

Figure 6:
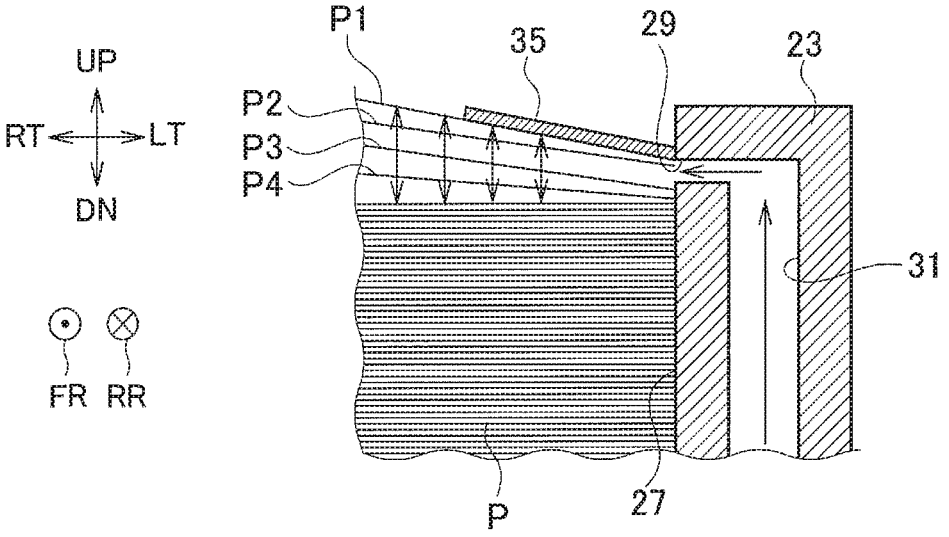
FIG. 6 is an explanatory view illustrating a phenomenon occurring to the uppermost part of the sheets stacked on the sheet feed device of FIG. 2 when air blows from the air blow opening to the uppermost part of the sheets.

Moreover, while the second sheet P2 is lifted toward the top sheet P1, as illustrated in the explanatory view of FIG. 6, a phenomenon similar to a phenomenon occurring between the top sheet P1 whose edge is sucked toward the flow adjuster 35 and the second sheet P2 occurs between the second sheet P2 and the third sheet P3. Furthermore, while the third sheet P3 is lifted toward the second sheet P2, a phenomenon similar to the phenomenon occurring between the second sheet P2 sucked toward the top sheet P1 and the third sheet P3 occurs between the third sheet P3 and the fourth sheet P4.

Then, these upward and downward movements of the second sheet and beyond (sheets P2, P3 applies fine vibration to the top sheet P1 from the lower surface thereof and this vibration causes the top sheet P1 and the second sheet P2, the second sheet P2 and the third sheet P3, and any two adjacent sheets P from the third sheet and beyond at the uppermost part of the sheets P stacked on the sheet feed tray 21 to be separated from each other in a short time.

Accordingly, the top sheet P1 and the second sheet P2 can be separated from each other at high speed by using the air from the air blow opening 29 which blows from the side of the uppermost part of the sheets P stacked on the sheet feed tray 21, without depending on an operation of a mechanical element.

Thus, it is possible to cause the external sheet feed unit 12 to feed the top sheet P1 on the sheet feed tray 21 to the conveyance route Rat high speed and allow the inkjet recording apparatus 1 to sufficiently exhibit its print processing performance.

Regarding the aforementioned first embodiment, in the apparatus described in Japanese Patent No. 4492429, in order for the image forming apparatus to sufficiently exhibit its print processing performance, air needs to intermittently blow from the sides of the uppermost part of the stacked sheets at a cycle corresponding to the print processing performance of the image forming apparatus. However, in the apparatus of Japanese Patent No. 4492429 which achieves intermittent air blowing by means of opening and closing operations of shutters, there is inevitably a limit to how short the cycle of intermittent air blowing can be made due to the specifications of mechanical elements relating to the opening and closing operations of the shutters.

Moreover, the sheet feed device 20 of the first embodiment is configured such that the air blowing from the air blow openings 29 to the left and right portions of the uppermost part of the sheets P stacked on the sheet feed tray 21.

Accordingly, it is possible to separate the top sheet P and the next sheet P at the uppermost part of the sheets P stacked on the sheet feed tray 21 from each other in the left and right portions thereof in a short time and more surely separate the top two sheets P at the uppermost part of the sheets P stacked on the sheet feed tray 21 at high speed.

Furthermore, the sheet feed device 20 of the first embodiment is configured such that the left and right portions of the sheets P stacked on the sheet feed tray 21 are brought into contact with the guides 23 and air blows in both of left and right directions from the air blow openings 29 of the guides 23 to the side portions of the uppermost part of the sheets P stacked on the sheet feed tray 21. Accordingly, the guides 23 restrict movements of the sheets P on the sheet feed tray 21 in the left-right direction. Hence, when the air blows from the air blow openings 29 to the uppermost part of the sheets P stacked on the sheet feed tray 21, separation of the top sheet P1 from the second sheet P2 can be facilitated by moving the top sheet P1 toward the flow adjusters 35 on the upper side toward which the guides 23 do not restrict the movement.

Note that the angle of the flow adjuster 35 extending from the upper edge of the air blow opening 29 of each guide 23 may be fixed. Alternatively, the flow adjuster 35 may be attached to the guide 23 via a hinge mechanism and the like (not illustrated) to be configured to be swingable in a standing-lying direction (up-down direction).

Figure 7A:
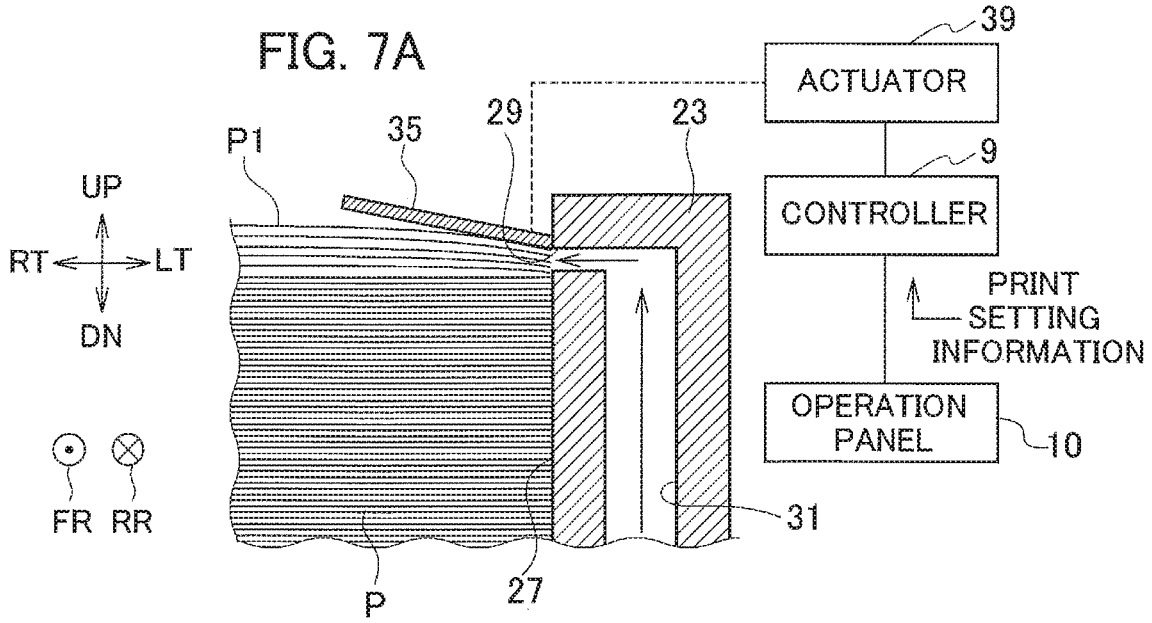
FIG. 7A is an explanatory view illustrating a configuration which adjusts the angle of a flow adjuster in FIG. 2.

In this case, the angle of the flow adjuster 35 may be manually adjustable or be adjustable by using drive force of an actuator 39 as illustrated in the explanatory view of FIG. 7A. Moreover, in the case of using the actuator 39, the configuration may be such that the angle of the flow adjuster 35 is automatically adjusted by control of the controller 9.

Furthermore, when the controller 9 is configured to adjust the angle of the flow adjuster 35, the configuration may be such that the controller 9 adjusts the angle of the flow adjuster 35 to an appropriate angle depending on, for example, the print setting information in the print job inputted into the inkjet recording apparatus 1, the information on the specifications (sheet size, sheet type, and the like) of the sheets P inputted on the operation panel 10, or the information on the environment (temperature, humidity, and the like) of the location where the inkjet recording apparatus 1 is installed.

Figure 7B:
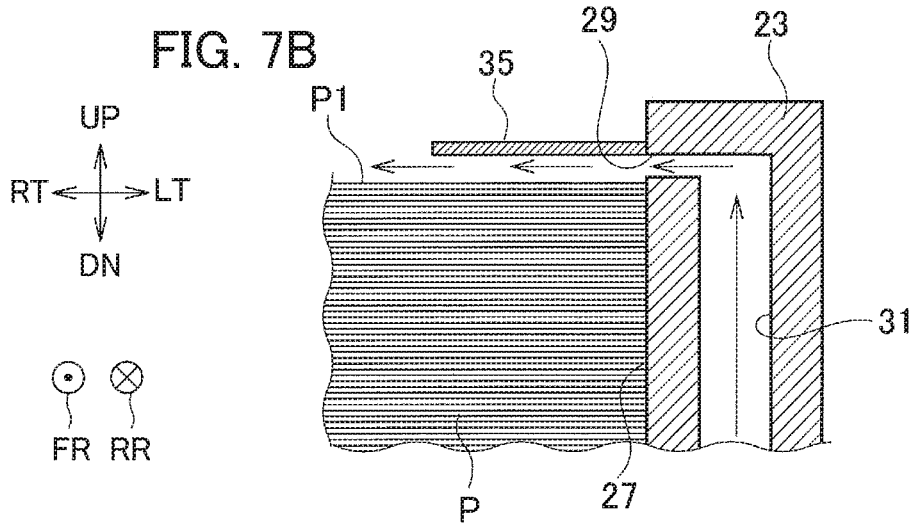
FIG. 7B is an explanatory view illustrating the configuration which adjusts the angle of the flow adjuster in FIG. 2.
Figure 7C:
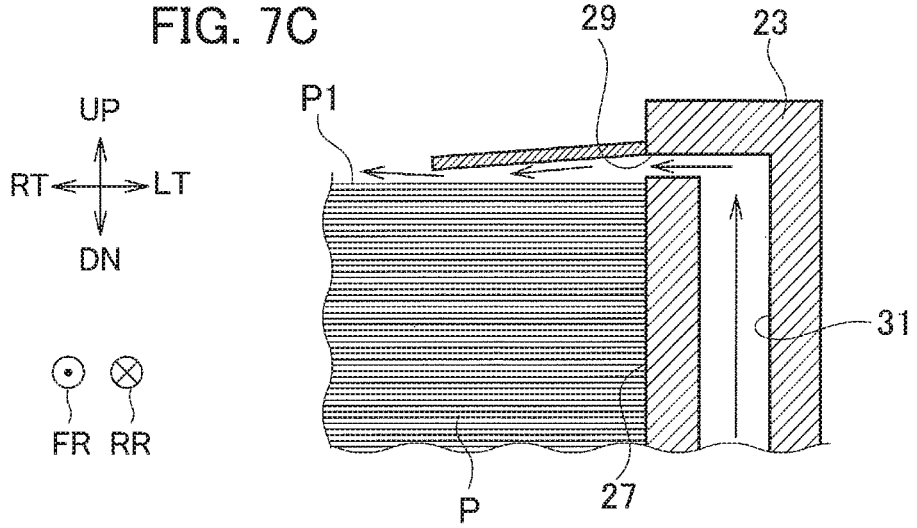
FIG. 7C is an explanatory view illustrating the configuration which adjusts the angle of the flow adjuster in FIG. 2.

In the configuration in which the angle of the flow adjuster 35 is adjustable, it is possible to set the angle of the flow adjuster 35 to be horizontal relative to the uppermost part of the sheets P stacked on the sheet feed tray 21 as illustrated in the explanatory view of FIG. 7B, to adjust the angle of depression of the flow adjuster 35 relative to the uppermost part of the sheets Pas illustrated in the explanatory view of FIG. 7C, and to adjust the angle of elevation of the flow adjuster 35 relative to the uppermost part of the sheets P as illustrated in FIG. 7A.

Accordingly, for example, when the degree of adherence between the sheets P differs or varies depending on the information on the specifications such as the size, thickness (basis weight), stiffness, and paper quality (smoothness of the surfaces) of the sheets P stacked on the sheet feed tray 21 and the temperature, humidity, and the like of the location where the inkjet recording apparatus 1 is installed, the angle of the flow adjuster 35 can be adjusted to an angle of elevation or depression corresponding to the degree of the adherence between the sheets P.

The angle of elevation or depression of the flow adjuster 35 can be thereby easily adjusted to an angle at which the air blowing from the air blow opening 29 tends to become the air flow A1 flowing along the lower surface of the flow adjuster 35 due to the Coandă effect.

Although the case where the sheet feed device 20 is part (external sheet feed tray 11) of the inkjet recording apparatus 1 is described in the first embodiment, the sheet feed device 20 may be an externally-attached device which is used by being connected to the inkjet recording apparatus 1.

Moreover, although the case where the sheet feed device 20 is applied to the external sheet feed tray 11 of the inkjet recording apparatus 1 to supply the sheets P to the printer 3 is described in the first embodiment, the sheet feed device 20 can be widely applied to various devices which supply thin sheets other than paper sheets to a supply target one by one.

Moreover, the configuration may be such that the wind volume of the fan 33 in each guide 23 can be adjusted by control of the controller 9 as illustrated in FIG. 2.

The flow velocity of the air blowing from the air blow opening 29 can be thereby adjusted. In this case, the air flow A1 flowing through the gap B1 between the top sheet P1 and the flow adjuster 35 and the gap between the two sheets P becomes a flow which entrains air present in the gap between the sheets P due to the nature of the jet and generates a negative pressure in the gap. Accordingly, this negative pressure can be adjusted to a level corresponding to the degree of adherence between the sheets P.

Note that the configuration which causes air to blow from the air blow opening 29 to the side portions of the uppermost part of the sheets P stacked on the sheet feed tray 21 may be provided on each of the left and right sides of the sheets P stacked on the sheet feed tray 21 as in the inkjet recording apparatus 1 of the first embodiment or provided only on one of the left and right sides.

Moreover, the configuration which causes air to blow from the air blow opening 29 to the side portions of the uppermost part of the sheets P stacked on the sheet feed tray 21 may be provided on the rear side of the sheets P in the conveyance direction (front-rear direction in FIG. 1) of the sheets P on the sheet feed tray 21, in addition to or instead of the air blow opening (s) 29 provided on both or one of the left and right sides of the sheets P.

The first embodiment has, for example, the following configuration.

A sheet supplying device includes: an air blow opening configured to blow air to a side portion of an uppermost part of stacked sheets; and a flow adjuster extending from above the air blow opening over an edge of a top sheet of the stacked sheets and configured to cause an air flow blown from the air blow opening to travel along an upper surface of the top sheet of the stacked sheets.

In the aforementioned sheet supplying device, the direction of the jet of the air blowing from the air blow opening is adjusted by the flow adjuster extending above each of the edges of the stacked top sheet due to the Coandă effect, and becomes the air flow flowing along the lower surface of the flow adjuster facing the upper surface of the top sheet.

The air flow flowing along the lower surface of the flow adjuster becomes the air flow traveling toward the front end of the flow adjuster in the extending direction thereof while entraining air present in the gap between the top sheet and the flow adjuster due to the nature of the jet. The air flow reaching the front end of the flow adjuster becomes the air flow moving away from the stacked sheets due to the diffraction effect occurring at the front end of the flow adjuster.

Accordingly, the gap between the stacked top sheet and the flow adjuster extending over the edge of the top sheet is set to a negative pressure state and the edge of the top sheet is sucked toward the flow adjuster. Thus, a gap is formed between the top sheet whose edge is sucked toward the flow adjuster and the second sheet from the top which is stacked. As described above, the flow adjuster can cause the stacked top sheet to be surely lifted and separated from the second sheet P2.

Then, the air blowing from the air blow opening flows through the gap formed between the top sheet sucked toward the flow adjuster and the second sheet from the top. The air flow flowing through the gap between both sheets provides lift to the top sheet sucked toward the flow adjuster and maintains the top sheet in the state lifted to a point where the edge of the top sheet comes into contact with the flow adjuster.

Moreover, the air flow blowing from the air blow opening becomes an air flow flowing along the lower surface of the top sheet due to the Coandă effect when flowing through the gap between the top sheet and the second sheet from the top. This air flow flows out from peripheral edges of both sheets to the sides of the stacked sheets. Accordingly, the gap between both sheets is set to a negative pressure state. Thus, the second sheet is sucked toward the lifted top sheet.

However, the gap between top sheet and the second sheet from the top spreads over the entire surfaces of both sheets and the volume of this gap is larger than the volume of the gap between the edge of the top sheet and the flow adjuster. Accordingly, the flow velocity of the air flow flowing through the gap between the top sheet and the second sheet from the top decreases and the intensity of the jet becomes smaller than that of the air flow flowing through the gap between the edge of the top sheet and the flow adjuster. Thus, a lower negative pressure than a negative pressure generated in the gap between the edge of the top sheet and the flow adjuster is generated in the gap between the top sheet and the second sheet from the top.

Hence, the suction force sucking the second sheet toward the top sheet is smaller than the suction force sucking the edge of the top sheet toward the flow adjuster and the lift amount of the second sheet is smaller than the lift amount of the top sheet.

Thus, the flow rate of the air flow flowing through the gap between the second sheet sucked toward the top sheet and the stacked third sheet is lower than the flow rate of the air flow flowing through the gap formed between the top sheet sucked toward the flow adjuster and the second sheet from the top.

Accordingly, the lift provided to the second sheet by the air flowing through the gap between the second sheet and the stacked third sheet is smaller than the lift provided to the top sheet by the air flowing through the gap formed between the top sheet and the second sheet from the top. Thus, the second sheet sucked toward the top sheet drops toward the stacked third sheet in the middle of suction toward the top sheet, due to the weight of the second sheet itself or turbulence in the air flow flowing through the gap between the second sheet and the third sheet.

Thereafter, the second sheet is repeatedly lifted and dropped in the aforementioned process and moves up and down between the top sheet lifted to the point where the edge comes into contact with the flow adjuster and the stacked sheet. In other words, the second sheet moves up and down in a short cycle between the top sheet and the stacked sheet by an action which involves no operation of a mechanical element.

Moreover, the phenomenon similar to the aforementioned phenomenon occurring between the top sheet and the second sheet occurs between the second sheet and the third sheet and between any two adjacent sheets from the third sheet and beyond at the uppermost part of the stacked sheets.

Then, these upward and downward movements of the second sheet and beyond applies fine vibration to the top sheet from the lower surface thereof and this vibration causes the top sheet and the second sheet, the second sheet and the third sheet, and any two adjacent sheets from the third sheet and beyond present in the uppermost part of the stacked sheets to be separated from each other in a short time.

Accordingly, the top sheet and the next sheet can be separated from each other at high speed by using the air blowing from the sides of the uppermost part of the stacked sheets, without depending on an operation of a mechanical element.

The air blow opening may include a plurality of blow openings configured to blow air to the side portion of the uppermost part of the stacked sheets from a plurality of directions.

In the aforementioned configuration, air blows from the multiple air blow openings to the side portions of the uppermost part of the stacked sheets in different directions. Accordingly, the stacked top sheet is separated from the second sheet in short time in the multiple edges of the top sheet. Thus, both sheets can be more surely separated from each other at high speed.

The sheet supplying device may further include a guide in contact with the side portion of the stacked sheets and including an air flow passage in communication with the air blow opening inside the guide.

In the aforementioned configuration, since the air flow passage which supplies air to the air blow opening is provided inside each of the guides coming into contact with the side portions of the stacked sheets, it is possible to cause air to blow from the air blow opening to the side portions of the uppermost part of the stacked sheets while restricting the sideways movement of the stacked sheets with the guides.

Accordingly, the air blowing the side portions of the uppermost part of the stacked sheets can move the top sheet and the second sheet to the upper side (toward the flow adjuster) toward which the guides do not restrict the movement.

The air blow openings may be formed to have a smaller flow passage cross-sectional area than that of the air flow passages.

In the aforementioned configuration, the flow velocity of air having passed the air flow passage in each guide increases at the air blow opening due to the decrease in the flow passage cross-sectional area. Accordingly, the air blowing from the air blow opening flows at high speed through the gap between the edge of the stacked top sheet and the flow adjuster.

In this case, the air flow flowing through the top sheet and the flow adjuster becomes a flow which entrains air therearound due to the nature of the jet and generates a negative pressure in the gap between the top sheet and the flow adjuster. Accordingly, it is possible to increase the thus-generated negative pressure and suck the edge of the top sheet toward the air flow adjuster with greater suction force.

The flow adjusters may be configured such that the angle of elevation or depression relative to the stacked top sheet is adjustable.

In the aforementioned configuration, the angle of elevation or depression of the flow adjuster can be easily adjusted to an angle at which the air blowing from the air blow opening tends to become the air flow flowing along the lower surface of the flow adjuster due to the Coandă effect.

The sheet supplying device may further include an angle adjuster configured to adjust an angle of elevation or depression of the flow adjuster relative to the top sheet of the stacked sheets, based on at least one of information on a specification of the stacked sheets or information on an environment around the stacked sheets.

In the aforementioned configuration, the angle of elevation or depression of the flow adjuster is adjusted depending on the information on specifications such as the size, thickness, stiffness (firmness), and smoothness of the surfaces of the stacked sheets and the information on the environment (temperature, humidity, and the like) around the stacked sheets.

Accordingly, when the degree of adherence between the stacked sheets differs or varies depending on the specifications of the stacked sheets and the condition of the environment around the sheets, the angle of the flow adjuster can be adjusted to an angle of elevation or depression corresponding to the degree of the adherence between the sheets. In this case, the air flow flowing through the gap between the top sheet and the flow adjuster becomes a flow entraining air present in the gap between the top sheet and the flow adjuster due to the nature of the jet and generates a negative pressure in the gap. Accordingly, this negative pressure can be adjusted to a level corresponding to the degree of adherence between the sheets.

The sheet supplying device may further include a flow rate adjuster configured to adjust a flow rate of the air blown from the air blow opening.

In the aforementioned configuration, the flow rate of the air flow flowing through the gap between the top sheet and the flow adjuster can be adjusted by adjusting the flow rate of the air blowing from the air blow opening. This air flow becomes a flow entraining air present in the gap between the top sheet and the flow adjuster due to the nature of the jet and generates a negative pressure in the gap. Accordingly, this negative pressure can be adjusted to an appropriate level.

Figure 8:
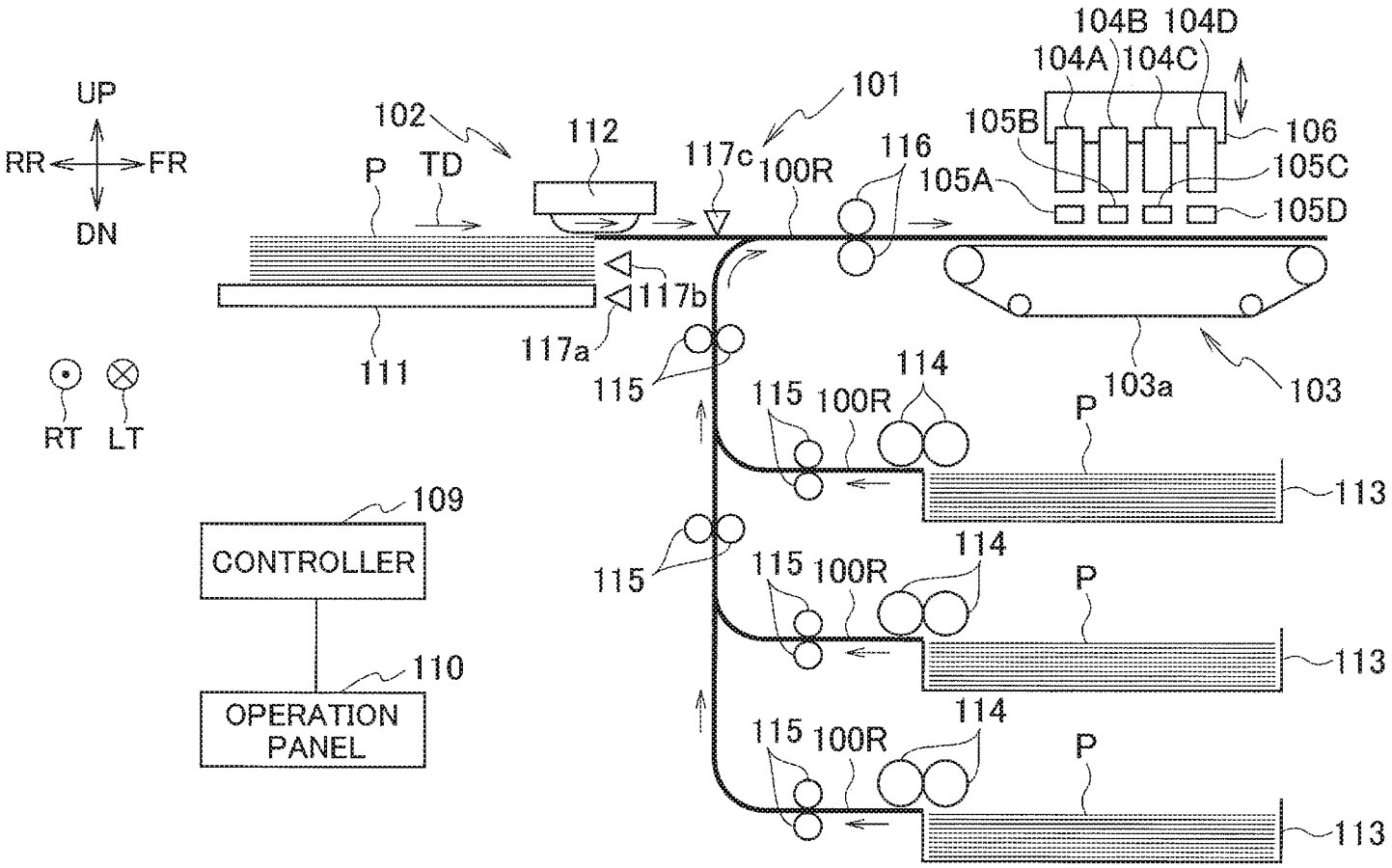
FIG. 8 is an explanatory view illustrating a schematic configuration of a main portion of an inkjet recording apparatus in which a sheet feed device according to a second embodiment of the present invention is mounted.

FIG. 8 is an explanatory view illustrating a schematic configuration of a main portion of an inkjet recording apparatus 101 in which a sheet feed device 120 according to a second embodiment of the present invention is mounted. Note that the inkjet recording apparatus 101 illustrated in FIG. 8 is assumed to be an inkjet line color printer but the type of the apparatus is not limited to this.

Moreover, in the following description, a direction orthogonal to the sheet surface of FIG. 8 is referred to as left-right direction and a direction from the sheet surface toward the viewer is referred to as right. Furthermore, up and down in the sheet surface of FIG. 8 is referred to as up-down direction and the horizontal direction in the sheet surface of FIG. 8 is referred to as front-rear direction. Note that directions toward right and left of the sheet surface are referred to as front and rear, respectively. Moreover, a route illustrated by bold lines in FIG. 8 is a conveyance route 100R through which, for example, sheets P being print media are conveyed. Upstream and downstream in the following description mean upstream and downstream in the conveyance route 100R. In FIGS. 8 to 14 and 16, right, left, up, down, front, rear, and a conveyance direction are denoted by RT, LT, UP, DN, FR, RR, and TD, respectively.

As illustrated in FIG. 8, the inkjet recording apparatus 101 of the second embodiment includes a sheet feeder 102, a printer 103, a controller 109, and an operation panel 110.

The sheet feeder 102 feeds the sheets P to the printer 103. The sheet feeder 102 includes an external sheet feed tray 111, an external sheet feed unit 112, multiple internal sheet feed trays 113, multiple pairs of internal sheet feed rollers 114, multiple pairs of internal sheet feed conveyance rollers 115, and registration rollers 116.

The external sheet feed tray 111 is a tray on which the sheets P to be used in printing are stacked. The external sheet feed tray 111 is installed to be partially exposed to the outside of a housing (not illustrated) of the inkjet recording apparatus 101.

The external sheet feed unit 112 picks up the sheets P from the external sheet feed tray 111 one by one and conveys the sheets P to the registration rollers 116 along the conveyance route 100R. A sheet sensor 117*c* which detects the thickness of the conveyed sheets P is provided on the conveyance route 100R on the exit side of the external sheet feed unit 112. A sheet feed tray stop sensor 117*a* which stops lifting of the external sheet feed tray 111 and a sheet lift sensor 117*b* which detects whether the sheet P is lifted from the external sheet feed tray 111 are provided on an inner wall surface 127.

The internal sheet feed trays 113 are trays on which the sheets P to be used in printing are stacked. The internal sheet feed trays 113 are arranged inside the housing (not illustrated) of the inkjet recording apparatus 101.

The internal sheet feed rollers 114 pick up the sheets P from the internal sheet feed trays 113 one by one and sends the sheets P to the conveyance route 100R. The internal sheet feed rollers 114 are rotationally driven by a not-illustrated motor.

The internal sheet feed conveyance rollers 115 convey the sheets P picked up from the internal sheet feed trays 113 to the registration rollers 116. The internal sheet feed conveyance rollers 115 are arranged between the internal sheet feed rollers 114 and the registration rollers 116, along the conveyance route 100R. The internal sheet feed conveyance rollers 115 are rotationally driven by a not-illustrated motor.

The registration rollers 116 temporarily stop each of the sheets P conveyed from the external sheet feed unit 112 or the internal sheet feed conveyance rollers 115 and then convey the sheet P to the printer 103. The registration rollers 116 are arranged downstream of the external sheet feed unit 112 and the internal sheet feed conveyance rollers 115. The registration rollers 116 are rotationally driven by a not-illustrated motor.

The printer 103 includes a belt platen portion 103*a* and four inkjet heads 104A to 104D which correspond respectively to colors of CKMY.

The belt platen portion 103*a* conveys the sheets P fed from the sheet feeder 102 while sucking and holding the sheets P on a belt. The belt platen portion 103*a* is arranged downstream of the registration rollers 116.

The inkjet heads 104A to 104D print images on the sheets P conveyed by the belt platen portion 103*a* by ejecting color inks corresponding to the respective inkjet heads 104A to 104D to the conveyed sheets P. The inkjet heads 104A to 104D are arranged above the belt platen portion 103*a*.

A head gap adjuster 106 can move the inkjet heads 104A to 104D in the up-down direction. The head gap adjuster 106 can adjust a gap (head gap) between the inkjet heads 104A to 104D and the sheet P conveyed by the belt platen portion 103*a* by lifting and lowering the inkjet heads 104A to 104D.

Cleaners 105A to 105D corresponding to the respective inkjet heads 104A to 104D are provided below the inkjet heads 104A to 104D. The cleaners 105A to 105D receive the inks discharged by the inkjet heads 104A to 104D in a purging operation for cleaning.

Moreover, the cleaners 105A to 105D wipe the nozzle surfaces of the inkjet heads 104A to 104D to remove the inks discharged by the inkjet heads 104A to 104D in the purging operation and remaining on the nozzle surfaces.

A print job from the outside is inputted into the controller 109. The operation panel 110 is connected to the controller 109. Various pieces of information relating to printing such as, for example, information on specifications (sheet size, sheet type, and the like) of the sheets P stacked on the external sheet feed tray 111 and the internal sheet feed trays 113 of the sheet feeder 102 and information on an environment (temperature, humidity, and the like) of a location where the inkjet recording apparatus 101 is installed are inputted on the operation panel 110 by a user as necessary.

The controller 109 supplies the sheets P in the external sheet feed tray 111 and the internal sheet feed trays 113 to the printer 103 and causes the printer 103 to print images on the sheets P based on print setting information in the inputted print job and the information inputted on the operation panel 110.

Next, a schematic configuration of the sheet feed device 120 according to the second embodiment which is applied to the external sheet feed tray 111 is described with reference to the explanatory view of FIG. 9.

Figure 9:
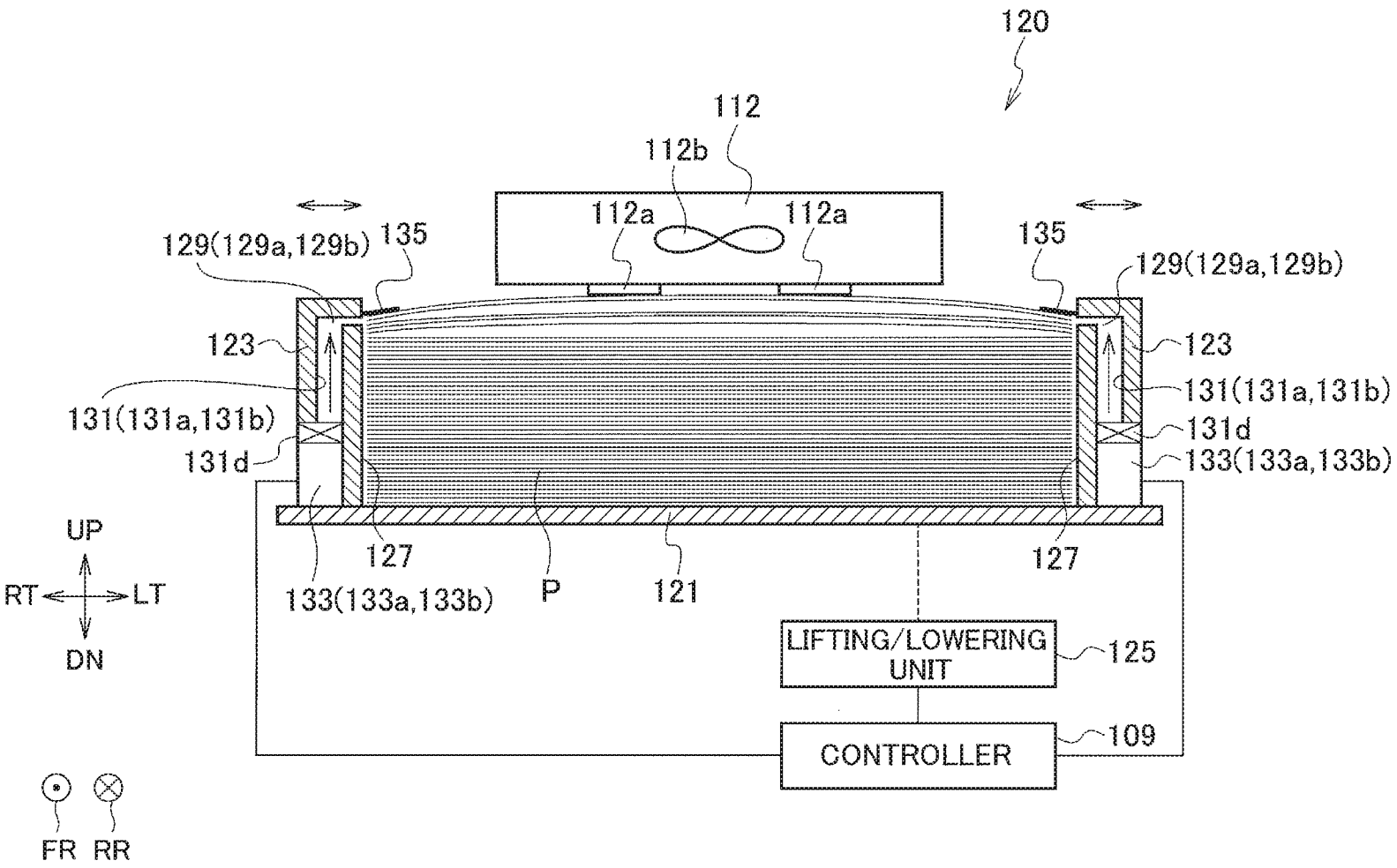
FIG. 9 is an explanatory view explaining the sheet feed device according to the second embodiment which is applied to an external sheet feed tray in FIG. 1.

As illustrated in FIG. 9, the sheet feed device 120 (sheet supplying device) applied to the external sheet feed tray 111 of FIG. 8 includes a sheet feed tray 121 on which the sheets P are stacked and placed and guides 123 which are provided to stand at left and right ends of the sheet feed tray 121 and in an end portion of the sheet feed tray 121 in the conveyance direction of the sheets. FIG. 9 illustrates a state where the sheet feed device 120 is viewed from a main body side (printer 103 side) of the inkjet recording apparatus 101 in FIG. 8.

The sheet feed tray 121 is lifted and lowered in the up-down direction by a lifting/lowering unit 125 depending on an increase and a decrease in the number of stacked sheets P. Specifically, the controller 109 functions as a lifting/lowering controller and causes the lifting/lowering unit 125 to lift and lower the sheet feed tray 121 based on the thickness detected by the sheet sensor 117*c* such that lift air blow openings 129*b* to be described later are located beside (at a side of) the uppermost part (for example, including top sheet P1) of the sheets P stacked on the sheet feed tray 121. To be more specific, since the stacked height of the sheets P stacked on the sheet feed tray 121 decreases by an amount equal to the thickness detected by the sheet sensor 117*c*, the controller 109 causes the lifting/lowering unit 125 to lift the sheet feed tray 121 when the added-up thickness of the sheets exceeds a threshold. Then, the controller 109 stops the lifting of the sheet feed tray 121 when the sheet feed tray stop sensor 117*a* used for positioning of the sheets turns on. Note that a sheet thickness sensor output value and sheet thickness table can be provided in advance in the controller 109 to accurately detect the position of the upper surface of the sheet.

The external sheet feed unit 112 conveys the sheets P in a circulation direction of a belt 112*a* rotationally driven by a not-illustrated motor, to the conveyance route 100R in front of the external sheet feed unit 112. Suction holes (not illustrated) for sucking air are provided in the belt 112*a*. Driving a fan 112*b* provided inside the belt 112*a* causes air to be sucked in from the suction holes in the belt 112*a* and this causes sheets P to be conveyed while being sucked on the surface of the belt 112*a*.

The guides 123 come into contact respectively with left and right end portions of the sheets P stacked on the sheet feed tray 21 and with an end portion of the sheet in the conveyance direction (only the guide members 123 for the left and right end portions are illustrated in FIG. 9) and restrict movement of the sheets P in the left-right direction and the conveyance direction. Note that the guides 123 are configured to be movable in the left-right direction relative to the sheet feed tray 121 depending on the size (sheet width) of the sheets P.

Figure 10:
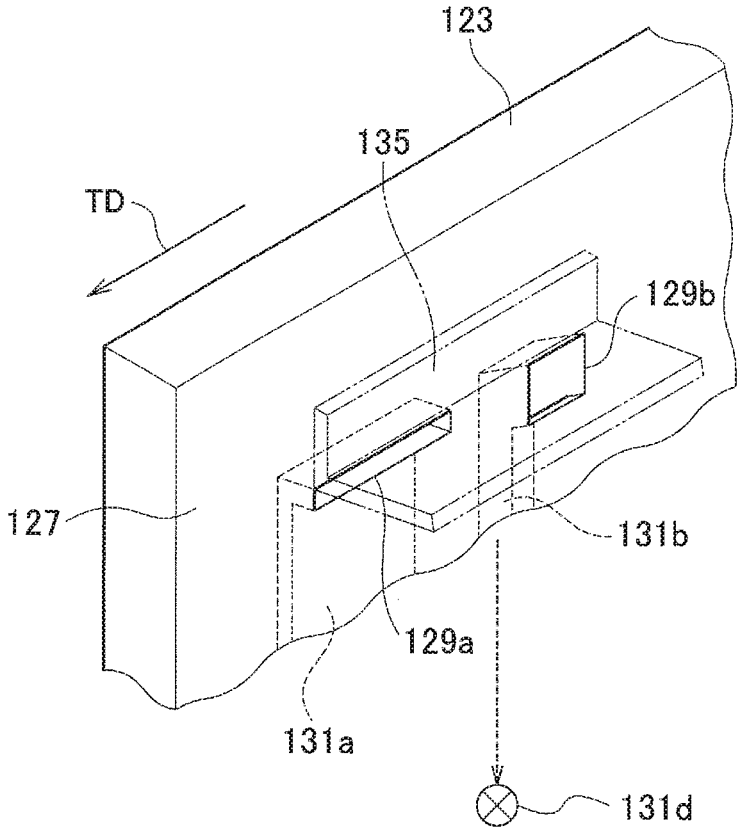
FIG. 10 is a perspective view illustrating a guide included in the sheet feed device according to the second embodiment and provided on a width side of the sheet.

An air blow opening 129 is formed at an upper end of an inner wall surface 127 of each guide 123 coming into contact with the sheets P. As illustrated in FIG. 10, the air blow opening 129 formed in each of the guides 123 provided on widthwise sides (left and right sides) of the sheets P includes a separation air blow opening 129*a* and a lift air blow opening 129*b*.

A flow adjuster 135 is attached to an upper edge of the air blow opening 129 (separation air blow opening 129*a*, lift air blow opening 129*b*). The flow adjuster 135 is provided to protrude, for example, at a predetermined attachment angle which is slightly upward relative to the horizontal direction, from the upper edge of the air blow opening 129 and extends above a left or right edge of the sheets P stacked on the sheet feed tray 121. Although the configuration in which the flow adjuster 135 is provided as one member at the upper edges of the separation air blow opening 129*a* and the lift air blow opening 129*b* is illustrated in FIG. 10, the flow adjuster 135 is not limited to this configuration. For example, the flow adjuster 135 may be separate members provided respectively for the separation air blow opening 129*a* and the lift air blow opening 129*b*. Moreover, the attachment angle of the flow adjuster 135 protruding from the upper edge of the separation air blow opening 129*a* may be different from that of the flow adjuster 135 protruding from the upper edge of the lift air blow opening 129*b*.

The lift air blow opening 129*b* causes air to blow from the side of the uppermost part of the sheets P stacked on the sheet feed tray 121 to lift the stacked sheets P. The air blowing from the lift air blow opening 129*b* forms an air flow along an upper surface of the top sheet P1 stacked on the sheet feed tray 121. This air flow lifts the sheets P stacked on the sheet feed tray 121 to the flow adjuster 135.

The shape of the lift air blow opening 129*b* is wider in the up-down direction than, for example, the shape of the separation air blow opening 129*a*. This shape is employed to extend the distance of lifting the top sheet P1 to the flow adjuster 135 and thereby facilitate separation of the second sheet P2 from the top sheet P1. Note that the shape of the lift air blow opening 129*b* may be any shape as long as the top sheet P1 can be lifted to the flow adjuster 135 and is not limited to the aforementioned shape.

The separation air blow opening 129*a* causes air to blow from the side in a direction orthogonal to the conveyance direction of the sheets P to between the top sheet P1 lifted to the flow adjuster 135 by the generated air flow and the second sheet P2.

The shape of the separation air blow opening 129*a* is narrower in the up-down direction and longer in the front-rear direction (conveyance direction) than, for example, the shape of the lift air blow opening 129*b*. This shape is employed to surely cause air to blow between the top sheet P1 lifted to the flow adjuster 135 and the second sheet P2 and increase an area of a region 100C1 where air flows collide with each other as described later to generate downward pressing force in a large area of the second sheet P2. Note that the shape of the separation air blow opening 129*a* may be any shape as long as air can blow between the top sheet P1 lifted to the flow adjuster 135 and the second sheet P2 and is not limited to the aforementioned shape.

Figure 11:
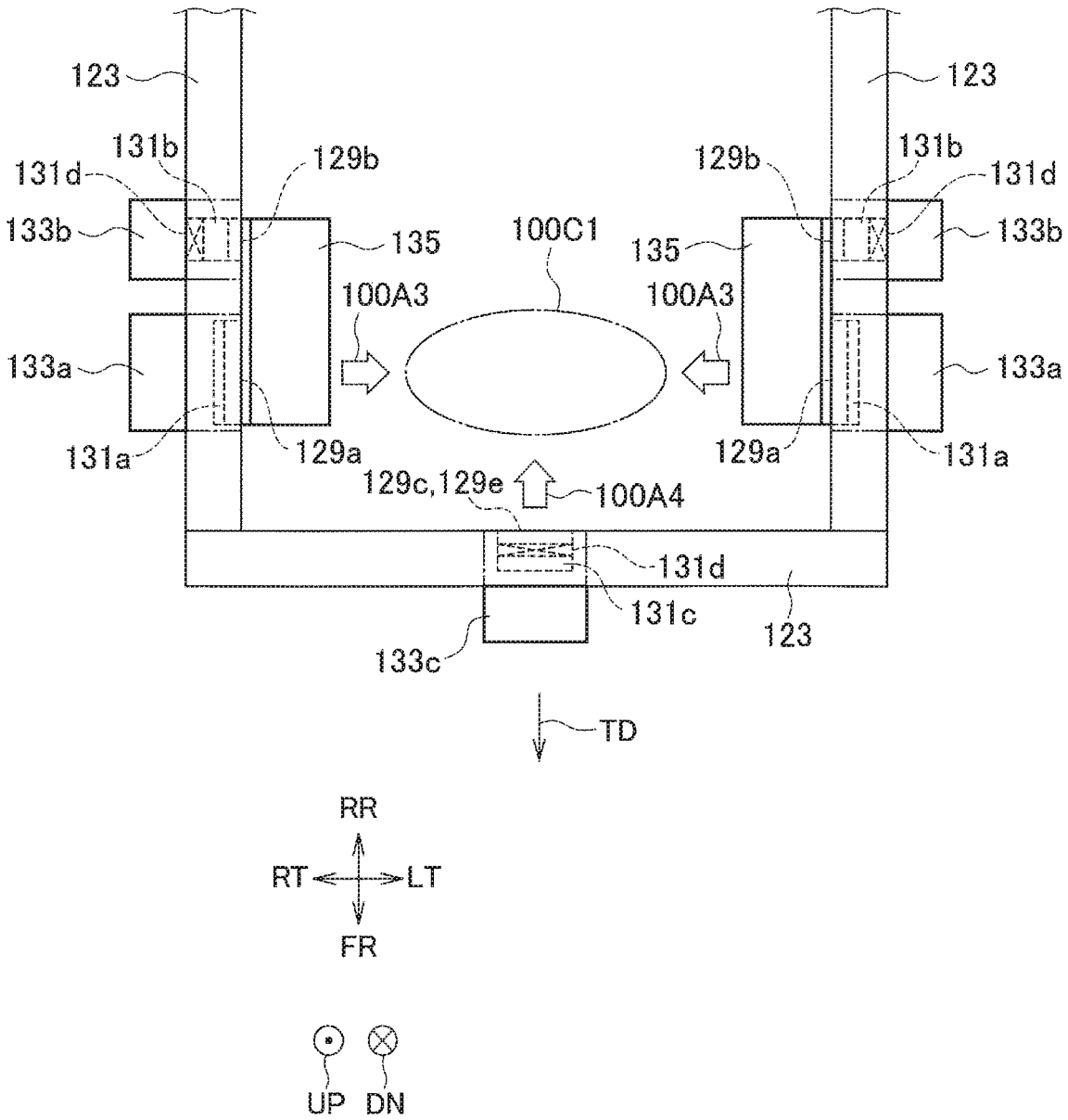
FIG. 11 is a plan view illustrating the sheet feed device according to the second embodiment.

As illustrated in FIGS. 10 and 11, an air flow passage 131 formed in each guide 123 includes a separation air flow passage 131*a* and a lift air flow passage 131*b*. The separation air blow opening 129*a* communicates with the separation air flow passage 131*a* and the separation air flow passage 131*a* is connected to a separation air sending mechanism 133*a* which generates an air flow. The lift air blow opening 129*b* communicates with the lift air flow passage 131*b* and the lift air flow passage 131*b* is connected to a lift air sending mechanism 133*b* which generates an air flow. The separation air flow passage 131*a* guides the air flow generated by the separation air sending mechanism 133*a* to the separation air blow opening 129*a* and the lift air flow passage 131*b* guides the air flow generated by the lift air sending mechanism 133*b* to the lift air blow opening 129*b*. As illustrated in FIGS. 9 and 11, in the lift air flow passages 131*b*, paired shutters 131*d* are provided respectively in center portions of the guides 123. Each of the shutters 131*d* performs opening and closing operations based on control signals from the controller 109. Switching can be thereby performed to cause air to blow or stop air from blowing from the lift air blow opening 129*b*. Specifically, the shutter 131*d* selectively opens and closes the lift air flow passage 131*b* to switch between air blowing and air stopping from the lift air blow opening 129*b*. Note that the shutter 131*d* may be provided in the lift air sending mechanism 133*a*.

Figure 12:
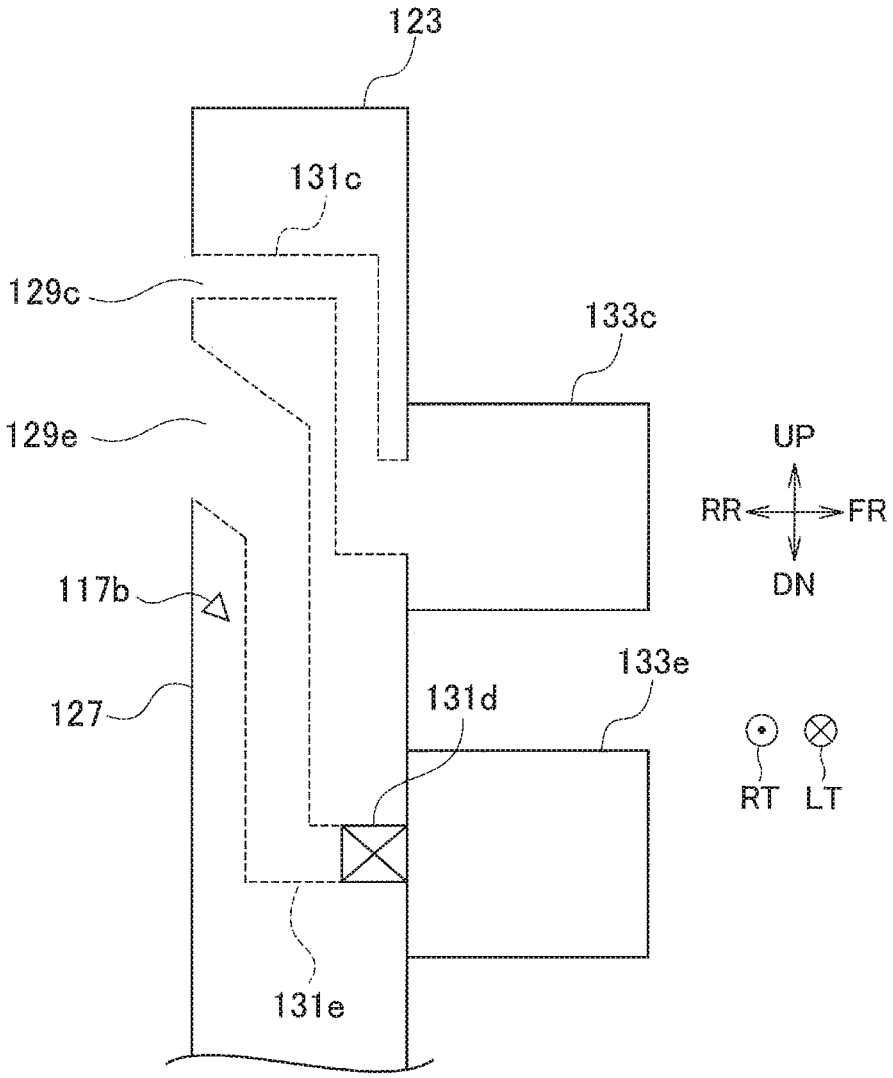
FIG. 12 is a cross-sectional view of the guide included in the sheet feed device according to the second embodiment and provided on a side of the sheet in the conveyance direction.

Moreover, as illustrated in FIGS. 11 and 12, the guide 123 is provided to stand also on the side of the sheet feed tray 121 in the sheet conveyance direction. A separation air blow opening 129*c* is provided at an upper end of the inner wall surface 127 of the guide 123 coming into contact with the sheets P, and a lift air blow opening 129*e* is provided below the separation air blow opening 129*c*.

The lift air blow opening 129*e* causes air to blow from the side of the uppermost part of the sheets P stacked on the sheet feed tray 121 to lift the stacked sheets P like the lift air blow openings 129*b*. The air blowing from the lift air blow opening 129*e* forms an air flow along the upper surface of the top sheet P1 stacked on the sheet feed tray 121. This air flow lifts the sheets P stacked on the sheet feed tray 121.

The separation air blow opening 129*c* communicates with a separation air flow passage 131*c* and the separation air flow passage 131*c* is connected to a separation air sending mechanism 133*c* which generates an air flow. The lift air blow opening 129*e* communicates with a lift air flow passage 131*e* and the lift air flow passage 131*e* is connected to a lift air sending mechanism 133*e* which generates an air flow. The separation air flow passage 131*c* guides the air flow generated by the separation air sending mechanism 133*c* to the separation air blow opening 129*c* and the lift air flow passage 131*e* guides the air flow generated by the lift air sending mechanism 133*e* to the lift air blow opening 129*e*.

The shutter 131*d* is provided in the lift air flow passage 131*e*. The shutter 131*d* performs opening and closing operations based on control signals from the controller 109. Switching between air blowing and air stopping from the lift air blow opening 129*e* can be thereby performed. Specifically, the shutter 131*d* selectively opens and closes the lift air flow passage 131*e* to switch between air blowing and air stopping from the lift air blow opening 129*e*. Note that the shutter 131*d* may be provided in the lift air sending mechanism 133*e*.

The separation air blow opening 129*c* causes air to blow from downstream of the sheets P in the conveyance direction thereof to between the top sheet P1 lifted by the air flows sent from and generated by the lift air blow openings 129*b* and the second sheet P2.

Air flows 100A3 blowing from the separation air blow openings 129*a* to between the top sheet P1 and the second sheet P2 and an air flow 100A4 blowing from the separation air blow opening 129*c* to between the top sheet P1 and the second sheet P2 collide with one another in the region 100C1. The pressure in the region 100C1 thereby increases and pushes the second sheet P2 downward. Thus, the second sheet P2 can be surely separated from the top sheet P1. As described above, the flow adjusters 135 can cause the top sheet P1 stacked on the sheet feed tray 121 to be surely lifted and separated from the second sheet P2.

Next, an operation of lifting the sheets P is described.

Figure 13:
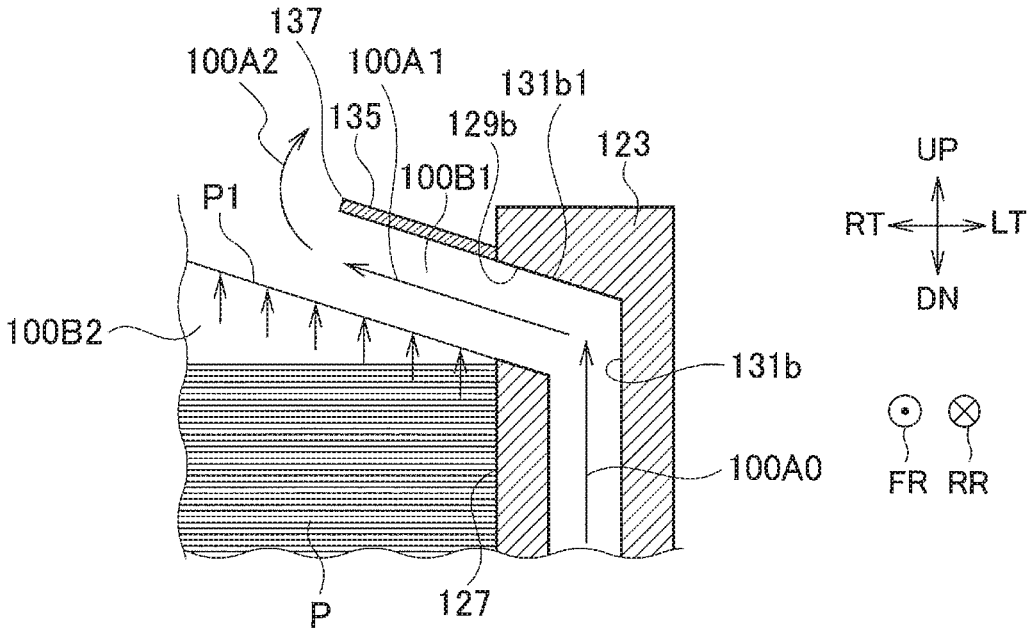
FIG. 13 is an explanatory view explaining an operation of lifting the sheets performed by the sheet feed device according to the second embodiment.

FIG. 13 is an explanatory view explaining an operation of lifting the sheets P by using the air flow blowing from each of the lift air blow openings 129*b* in the sheet feed device 120 of the second embodiment.

As illustrated in FIG. 13, the lift air flow passage 131*b* has a tilted surface 131*b*1 tilted in the left-right direction. For example, the tilted surface 131*b*1 is tilted at the same angle as the attachment angle of the flow adjuster 135. A flow direction of the air flow can be smoothly changed from the direction of an air flow 100A0 flowing through the lift air flow passage 131*b* to the direction of an air flow 100A1 to be described later.

A jet of the air blowing from the lift air blow opening 129*b* becomes the air flow 100A1 flowing along the lower surface of the flow adjuster 135 facing the upper surface of the top sheet P1 stacked on the sheet feed tray 121, due to the Coandă effect.

The air flow 100A1 flowing along the lower surface of the flow adjuster 135 travels toward a front end 137 of the flow adjuster 135 while entraining air present in a gap 100B1 between the top sheet P1 on the sheet feed tray 121 and the flow adjuster 135 due to the nature of the jet. The air flow 100A1 reaching the front end 137 of the flow adjuster 135 becomes the air flow 100A2 moving away from the stacked sheets P due to the diffraction effect occurring at the front end 137 of the flow adjuster 135.

Accordingly, the gap 100B1 between the top sheet P1 stacked on the sheet feed tray 121 and the flow adjuster 135 extending over the edge of the sheet P1 is set to a negative pressure state and the edge of the top sheet P1 is sucked toward the flow adjuster 135. Thus, as illustrated in the explanatory view of FIG. 13, a gap 100B2 is formed between the top sheet P1 whose edge is sucked toward the flow adjuster 135 and the second sheet P2 from the top which is stacked on the sheet feed tray 121.

Next, an operation of separating the top sheet P1 and the second sheet P2 from each other is described.

Figure 14:
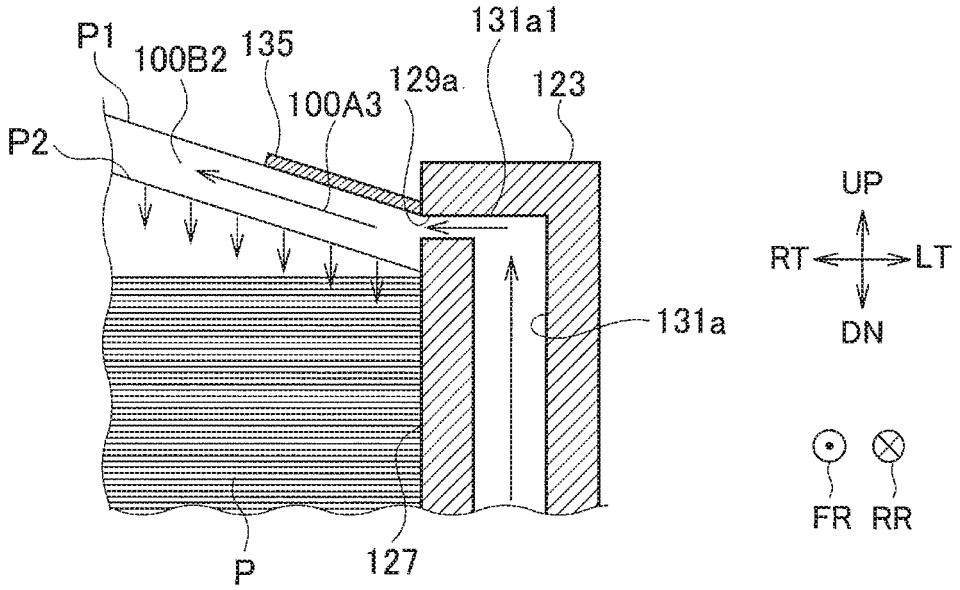
FIG. 14 is an explanatory view explaining an operation of separating the top sheet and the second sheet performed by the sheet feed device according to the second embodiment.

FIG. 14 is an explanatory view explaining the operation of separating the top sheet P1 and the second sheet P2 from each other by using the air flows blowing from each of the separation air blow openings 129*ab* in the sheet feed device 120 of the second embodiment.

As illustrated in FIG. 14, the separation air flow passage 131*a* has a horizontal surface 131*a*1.

Air hitting the horizontal surface 131*a*1 and blowing from the separation air blow opening 129*a* flows through the gap 100B2 formed between the top sheet P1 sucked toward the flow adjuster 135 and the second sheet P2 from the top and the air flow 100A3 is formed. Although not illustrated, air blowing from the separation air blow opening 129*c* similarly flows through the gap 100B2 and the air flow 100A4 is formed.

Then, as described above, the air flows 100A3 and the air flow 100A4 collide with one another and the pressure in the region 100C1 thereby increases to generate pressing force pushing the second sheet P downward. Accordingly, the second sheet P2 can be surely separated from the top sheet P1.

Next, operations of the sheet feed device 120 according to the second embodiment are described.

Figure 15:
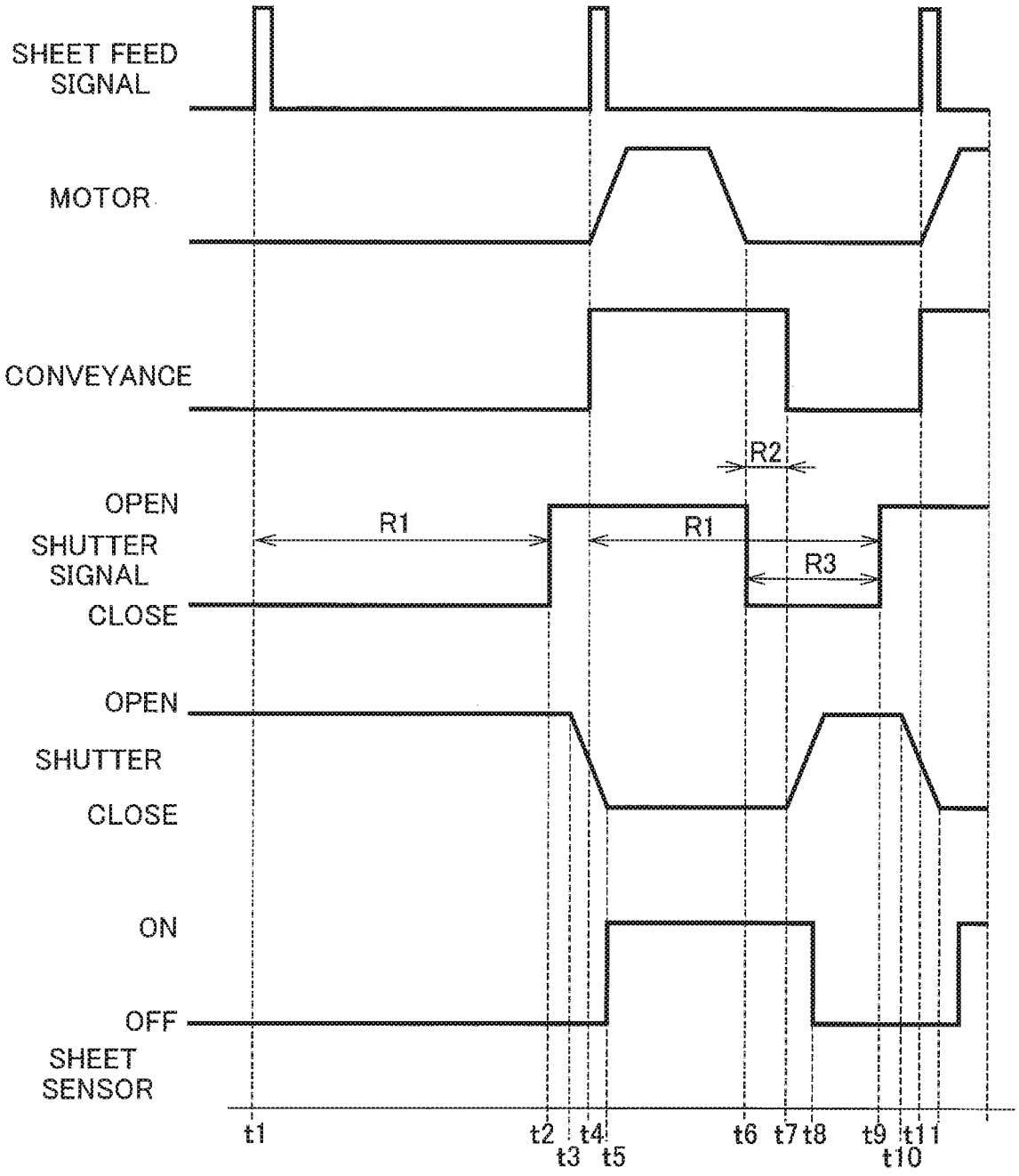
FIG. 15 is a timing chart explaining operations of the sheet feed device according to the second embodiment.

FIG. 15 is a timing chart explaining the operations of the sheet feed device 120.

As illustrated in FIG. 15, when a sheet feed signal is supplied from the controller 109 at a time point t1, a pre-operation is performed. This pre-operation is a preparation operation prior to the feeding of the sheets P. During the pre-operation, the controller 109 functions as an air controller and supplies a full-open signal for fully-opening the shutters 131*d* to maintain the shutters 131*d* in a fullyopened state. Air is thereby blowing from the lift air blow openings 129*b*, 129*e* illustrated in FIG. 11 in three directions. Air flows generated by this blowing of air lift the top sheet P1 stacked on the sheet feed tray 121 to the flow adjusters 135. Although not illustrated, air is made to blow also from the separation air blow openings 129*a*, 129*c*.

At a time point t2 which is a predetermined time R1 later from the time point t1, the controller 109 supplies a full-close signal for fully-closing the shutters 131*d* and thereby starts a closing operation of the shutters 131*d* at a time point t3.

When the next sheet feed signal is supplied from the controller 109 at a time point t4 just after the time point t3, the motor for rotationally-driving the belt 112*a* is activated. Then, until a time point t7, the sheet P (P1) is conveyed along the conveyance route 100R toward the printer 103 while being sucked to the surface of the belt 112*a* by means of air suction from the suction holes in the belt 112*a*. The sheet sensor 117*c* detects the thickness of the sheet P conveyed along the conveyance route 100R in a period from a time point t5 just after the start of conveyance to a time point t8 when the trailing end of the sheet P passes the sheet sensor 117*c*.

Since the shutters 131*d* are fully closed at the time point t5, air is stopped from blowing from the lift air blow openings 129*b*, 129*e*. In this case, since air blows from the separation air blow openings 129*a*, 129*c*, air flows between the top sheet P1 and the second sheet P2. Accordingly, the second sheet P2 is pushed downward by the pressing force of the flowing air and is stacked on the sheet feed tray 121.

As described above, after the top sheet P1 is lifted to the flow adjusters 135 by the generated air flows, the controller 109 functions as the air controller to control the shutters 131*d* such that air is stopped from blowing from the lift air blow openings 129*b*, 129*e* while the top sheet P1 is sucked by the external sheet feed unit 112.

This can surely separate the second sheet P2 from the top sheet P1 when the top sheet P1 is conveyed and prevent multiple sheets P from being sent simultaneously.

After the top sheet P1 is conveyed, preparation for conveying the second sheet P2 as the next top sheet P1 is performed. At a time point t6 which is a predetermined R2 earlier from the time point t7 when the conveyance of the top sheet P1 is completed, the controller 109 supplies the full-open signal for fully-opening the shutters 131*d*. At the time point t7, the full-open signal causes the shutters 131*d* to start an opening operation. Air thereby blows from the lift air blow openings 129*b*, 129*e*. Air flows generated by this blowing of air lift the next top sheet P1 stacked on the sheet feed tray 121 to the flow adjusters 135. Although not illustrated, air is made to blow also from the separation air blow openings 129*a*, 129*c*.

Then, at a time point t9 which is the predetermined time R1 later from the time point t4, the controller 109 supplies the full-close signal for fully-closing the shutters 131*d* and thereby starts the closing operation of the shutters 131*d* at a time point t10.

When the next sheet feed signal is supplied from the controller 109 at a time point t11 just after the time point t10, the motor for rotationally-driving the belt 112*a* is activated. Then, the sheet P is conveyed while being sucked to the surface of the belt 112*a* by means of air suction from the suction holes in the belt 112*a*.

Repeating these operations can surely separate the second sheet P2 from the top sheet P1 and appropriately convey the sheets P.

As described above, the sheet feed device 120 according to the second embodiment includes the lift air blow openings 129*b*, 129*e* which causes air to blow from the sides of the uppermost part of the stacked sheets P, the flow adjusters 135 which extend from the lift air blow openings 129*b* over the edges of the stacked top sheet P1 and which generate air flows along the upper surface of the stacked top sheet P1 from the air blowing from the lift air blow openings 129*b*, the separation air blow opening 129*c* which causes air to blow from the downstream side of the sheet P in the conveyance direction thereof to between the top sheet P1 lifted to the flow adjusters 135 by the generated air flows and the second sheet P2, and the separation air blow openings 129*a* which causes air to blow from the sides in the direction orthogonal to the conveyance direction to between the top sheet P1 and the second sheet P2, and the controller 109 functions as the air controller to lift the top sheet P1 to the flow adjusters 135 by using the generated air flows and then stop air from blowing from the lift air blow openings 129*b*, 129*e* while the external sheet feed unit 112 is sucking the top sheet P1.

More specifically, the controller 109 controls the opening-closing operations of the shutters 131*d* such that the top sheet P1 is lifted to the flow adjusters 135 by the generated air flows and then air is stopped from blowing from the lift air blow openings 129*b*, 129*e* while the external sheet feed unit 112 is sucking the top sheet P1.

Accordingly, the air flows generated from the air blowing from the separation air blow openings 129*a* and the air flow generated from the air blowing from the separation air blow opening 129*c* collide in the region 100C1. The pressure in the region 100C1 thereby increases and presses down the second sheet P2. Accordingly, it is possible to surely separate the second sheet P2 from the top sheet P1 and send out the sheets P from the top one by one.

In the apparatus described in Japanese Patent Application Publication No. 2012-131614, unlike in the aforementioned second embodiment, air flows blow only from side surfaces on sides in the direction orthogonal to a conveyance direction of a sheet. Accordingly, pressure in a portion between the top sheet and the second sheet does not increase. Thus, the second sheet is less likely to be separated from the top sheet and it is difficult to send the sheets from the top one by one.

In the second embodiment, the controller 109 supplies the full-open signal for fully opening the shutters 131*d* at the time point t6 which is the predetermined R2 earlier from the time point t7 when the conveyance of the top sheet P1 is completed, but the operation is not limited to this.

For example, the controller 109 may function as the air controller to determine the time from the time point when the instruction of stopping the air blowing from the lift air blow openings 129*b* is given to the time point when the instruction of starting the next air blowing from the lift air blow openings 129*b*, 129*e* is given, depending on the thickness and size of the sheets P. As illustrated in FIG. 15, the time R3 from the time point t6 being the time point when the instruction of stopping the air blowing from the lift air blow openings 129*b*, 129*e* is given to the time point t8 being the time point when the instruction of starting the next air blowing from the lift air blow openings 129*b*, 129*e* is given is time for lifting the top sheet P1 stacked on the sheet feed tray 121.

The larger the thickness of the sheets P is, the longer the time it takes to lift the sheets P. Accordingly, a schedule may be set such that the time R3 is increased when the thickness is large. Moreover, the larger the size of the sheets P is, the longer the time it takes to lift the sheets P. Accordingly, the schedule may be set such that the time R3 is increased when the size is large.

The top sheet P1 stacked on the sheet feed tray 121 can be appropriately lifted regardless of the thickness and size of the sheets P.

Moreover, the controller 109 functions as a lifting/lowering controller and causes the lifting/lowering unit 125 to lift and lower the sheet feed tray 121 based on the thickness detected by the sheet sensor 117*c* such that the lift air blow openings 129*b*, 129*e* are located beside (at a side of) the uppermost part of the sheets P stacked on the sheet feed tray 121. Specifically, since the stacked height of the sheets P stacked on the sheet feed tray 121 decreases by an amount equal to the thickness detected by the sheet sensor 117*c*, the sheet feed tray 121 is lifted by the amount equal to the thickness.

The uppermost part of the sheets P stacked on the sheet feed tray 121 are thereby located on the sides of the air blow openings 129*b*, 129*e*. Accordingly, the top sheet P1 stacked on the sheet feed tray 121 can be appropriately lifted.

Note that, although the configuration in which the separation air blow opening 129*c* is provided at the upper end of the inner wall surface 127 and the lift air blow opening 129*e* is provided below the separation air blow opening 129*c* as illustrated in FIG. 12 is described in the second embodiment, the configuration is not limited to this.

Figure 16:
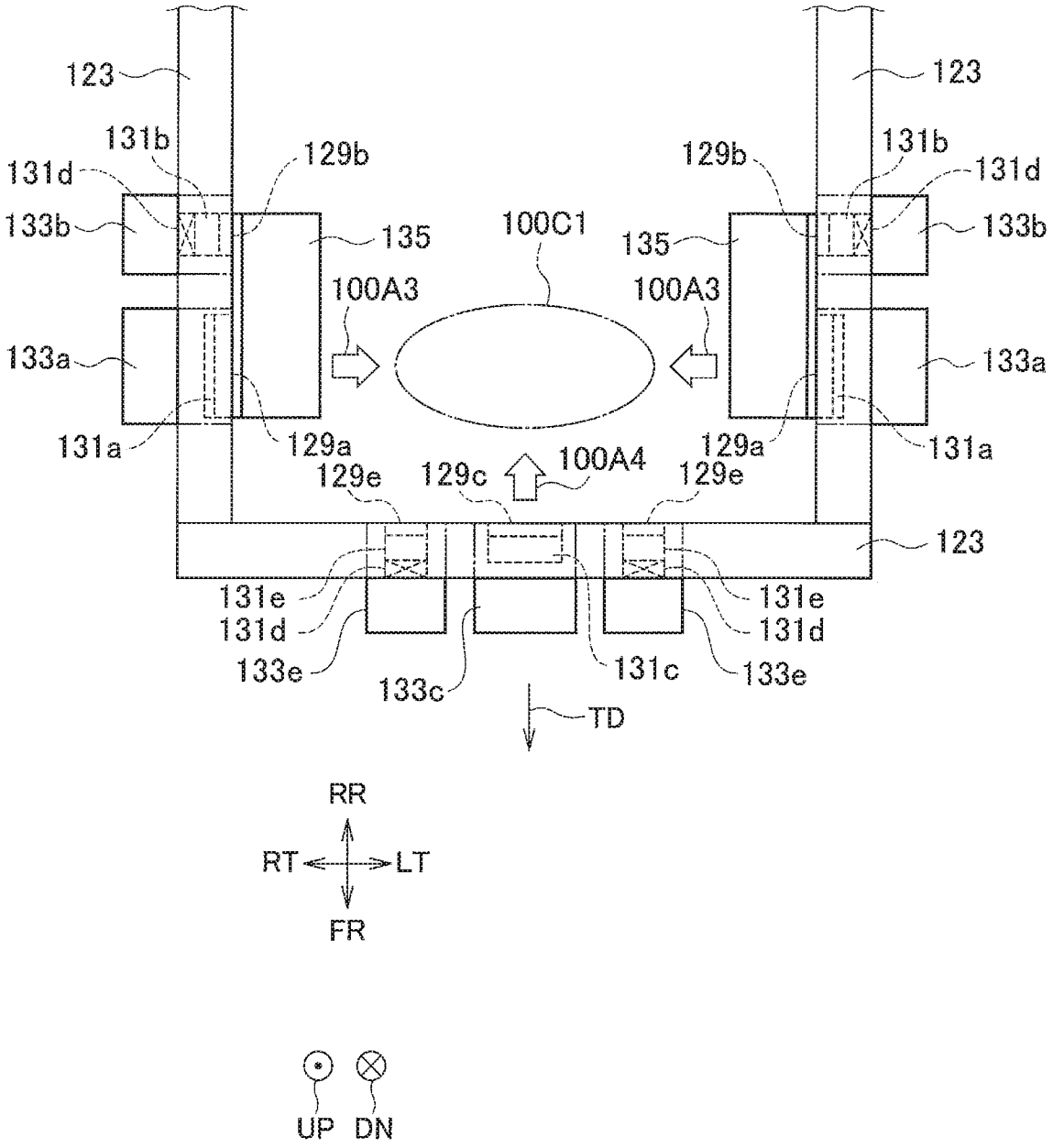
FIG. 16 is a plan view illustrating a modified example of the sheet feed device according to the second embodiment.

As in the modified example illustrated in FIG. 16, the lift air blow openings 129*e* may be provided on the left and right sides of the separation air blow opening 129*c*. Also in this case, the lift air blow openings 129*e* communicate with the lift air flow passages 131*e* and the lift air flow passages 131*e* are connected to the lift air sending mechanisms 133*e*. Moreover, the shutters 131*d* are provided in the lift air flow passages 131*e* and perform the opening-closing operations based on the control signals from the controller 109.

Moreover, although the guides 123 are configured to be movable in the left-right direction relative to the sheet feed tray 121 depending on the size (sheet width) of the sheets P, the guides 123 may be configured to be movable also in the front-rear direction. Accordingly, the guides 123 can be moved in the front-rear direction such that the lift air blow openings 129*b* are located at predetermined positions within the length of the sheets P in the conveyance direction (for example, downstream, in the conveyance direction, of the center portion in the length of the sheets P in the conveyance direction) to achieve more appropriate lifting of the sheets P. Thus, the sheets P can be lifted more appropriately.

Although the case where the sheet feed device 120 is part (external sheet feed tray 111) of the inkjet recording apparatus 101 is described in the second embodiment, the sheet feed device 120 may be an externally-attached device which is used by being connected to the inkjet recording apparatus 101.

Moreover, although the case where the sheet feed device 120 is applied to the external sheet feed tray 111 of the inkjet recording apparatus 101 to supply the sheets P to the printer 103 is described in the second embodiment, the sheet feed device 120 can be widely applied to various devices which supply thin sheets other than paper sheets to a supply target one by one.

The second embodiment has, for example, the following configuration.

A sheet supplying device includes: an air blow opening configured to blow air to a side portion of an uppermost part of stacked sheets; and a flow adjuster extending from above the air blow opening over an edge of a top sheet of the stacked sheets and configured to cause an air flow blown from the air blow opening to travel along an upper surface of the top sheet of the stacked sheets. The air blow opening may include: a lift air blow opening configured to blow air from a side of the uppermost part of the stacked sheets to lift the sheets; and a first separation air blow opening configured to blow air from the side of the uppermost part of the stacked sheets and a second separation air blow opening configured to blow air from a downstream side of the uppermost part of the stacked sheets in a conveyance direction, the first separation air blow opening and the second separation air blow opening configured to separate the sheets from one another by blowing of the air. The sheet supplying device may further include an air controller configured to control execution and stop of blowing of air from the lift air blow opening, control execution and stop of blowing of air from the first separation air blow opening, and control execution and stop of blowing of air from the second separation air blow opening. The flow adjuster may extend from above the lift air blow opening and the first separation air blow opening over the edge of the top sheet of the stacked sheets and may be configured to cause an air flow blown from the lift air blow opening to travel along the upper surface of the stacked top sheet. The air controller may be configured to: cause air to blow from the lift air blow opening and generate the air flow along the upper surface of the stacked top sheet; after the air flow generated from the air blown from the lift air blow opening lifts the stacked top sheet to the flow adjuster, stop the blowing of air from the lift air blow opening while the top sheet is sucked by a suction conveyor; and while stopping the blowing of air from the lift air blow opening, cause air to blow from the first separation air blow opening and the second separation air blow opening to between the top sheet lifted up to the flow adjuster and a second top sheet to separate the top sheet and the second top sheet from each other.

The sheet supplying device may further include: a lift air flow passage in communication with the lift air blow opening and configured to guide air to the lift air blow opening; and a shutter provided in the lift air flow passage and configured to selectively open and close the lift air flow passage to switch between air blowing and air stopping from the lift air blow opening. The air controller is configured to control the shutter.

The air controller may be configured to determine a time from a time point for stopping air from blowing from the lift air blow opening to a time point for staring to cause air to blow next, depending on a thickness and a size of the sheets.

The sheet supplying device may further include: a lifting/lowering unit configured to lift and lower a sheet stacking tray on which the sheets are stacked; a detector configured to detect a thickness of a sheet conveyed to a supply target device by the suction conveyor; and a lifting/lowering controller configured to drive the lifting/lowering unit to lift and lower the sheet stacking tray based on the thickness detected by the detector such that the lift air blow opening is arranged beside the stacked top sheet.

The sheet supplying device may further include a sheet stacking tray on which the sheets are stacked.

The sheet supplying device may further include a suction conveyor configured to suck the top sheet lifted up to the flow adjuster by way of air suction and supply the top sheet to a supply target device.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet supplying device comprising:

an air blow opening configured to blow air to a side portion of an uppermost part of stacked sheets on a sheet feed tray;

a flow adjuster extending from above the air blow opening over an edge of a top sheet of the stacked sheets and configured to cause an air flow blown from the air blow opening to travel along an upper surface of the top sheet of the stacked sheets;

a downstream guide of the sheet feed tray at a downstream end of the sheet feed tray in a conveyance direction of the sheets, wherein the air blow opening comprises:

a first separation air blow opening configured to blow air from the side of the uppermost part of the stacked sheets to separate the sheets from one another; and a second separation air blow opening configured to blow air from the downstream end of the sheet feed tray in an upstream direction upstream with respect to the conveyance direction of the sheets and toward an uppermost part of the stacked sheets to separate the sheets from one another, the first separation air blow opening comprises a plurality of blow openings configured to blow air to the side portion of the uppermost part of the stacked sheets from a plurality of directions, the second separation air blow opening is provided in an upper end of an inner wall surface of the downstream guide, the first separation air blow opening blows air in a lateral direction to collide in a region of the stacked sheets with air blown from the second separation air blow opening in the upstream direction, to increase the downward air pressure in the region on an adjacent sheet adjacent to and below the top sheet, thereby separating the adjacent sheet from the top sheet, and the sheet supplying device further comprises:

an operation panel inputting into the sheet supplying apparatus information on a specification of the stacked sheets and information on an environment around the stacked sheets; and an angle adjuster configured to adjust an angle of elevation or depression of the flow adjuster relative to the top sheet of the stacked sheets by using a drive force of an actuator, based on at least one of the information on the specification of the stacked sheets or the information on the environment around the stacked sheets.

2. The sheet supplying device according to claim 1, further comprising a guide in contact with the side portion of the stacked sheets and including an air flow passage in communication with the air blow opening inside the guide.

3. The sheet supplying device according to claim 1, further comprising a flow rate adjuster configured to adjust a flow rate of the air blown from the air blow opening.

4. The sheet supplying device according to claim 1, further comprising the sheet feed tray on which the sheets are stacked.

5. The sheet supplying device according to claim 1, further comprising a suction conveyor configured to suck the top sheet lifted up to the flow adjuster by way of air suction and supply the top sheet to a supply target device.

6. The sheet supplying device according to claim 1, wherein the flow adjuster extends from above the first separation air blow opening.

7. The sheet supplying device according to claim 1, wherein a lower surface of the flow adjuster and an upper edge of the first separation air blow opening align at a same height.

8. A sheet supplying device, comprising:

an air blow opening configured to blow air to a side portion of an uppermost part of stacked sheets on a sheet feed tray;

a flow adjuster extending from above the air blow opening over an edge of a top sheet of the stacked sheets and configured to cause an air flow blown from the air blow opening to travel along an upper surface of the top sheet of the stacked sheets;

a downstream guide of the sheet feed tray at a downstream end of the sheet feed tray in a conveyance direction of the sheets, wherein the air blow opening comprises:

a first separation air blow opening configured to blow air from the side of the uppermost part of the stacked sheets to separate the sheets from one another; and a second separation air blow opening configured to blow air from the downstream end of the sheet feed tray in an upstream direction upstream with respect to the conveyance direction of the sheets and toward an uppermost part of the stacked sheets to separate the sheets from one another, the first separation air blow opening comprises a plurality of blow openings configured to blow air to the side portion of the uppermost part of the stacked sheets from a plurality of directions, the second separation air blow opening is provided in an upper end of an inner wall surface of the downstream guide, the first separation air blow opening blows air in a lateral direction to collide in a region of the stacked sheets with air blown from the second separation air blow opening in the upstream direction, to increase the downward air pressure in the region on an adjacent sheet adjacent to and below the top sheet, thereby separating the adjacent sheet from the top sheet, the air blow opening further comprises:

a lift air blow opening configured to blow air from a side of the uppermost part of the stacked sheets to lift the sheet, the sheet supplying device further comprises an air controller configured to control execution and stop of blowing of air from the lift air blow opening, control execution and stop of blowing of air from the first separation air blow opening, and control execution and stop of blowing of air from the second separation air blow opening, and the air controller is configured to:

cause air to blow from the lift air blow opening and generate the air flow along the upper surface of the stacked top sheet;

a predetermined time after causing air to blow from the lift air blow opening for lifting the stacked top sheet to the flow adjuster by the air flow generated from the air blown from the lift air blow opening, stop the blowing of air from the lift air blow opening while the top sheet is sucked by a suction conveyor; and while stopping the blowing of air from the lift air blow opening, cause air to blow from the first separation air blow opening and the second separation air blow opening to between the top sheet lifted up to the flow adjuster and a second top sheet to separate the top sheet and the second top sheet from each other.

9. The sheet supplying device according to claim 8, further comprising:

a lift air flow passage in communication with the lift air blow opening and configured to guide air to the lift air blow opening; and a shutter provided in the lift air flow passage and configured to selectively open and close the lift air flow passage to switch between air blowing and air stopping from the lift air blow opening, wherein the air controller is configured to control the shutter.

10. The sheet supplying device according to claim 8, wherein the air controller is configured to determine a time from stopping air from blowing from the lift air blow opening to starting to cause air to blow next, depending on a thickness and a size of the sheets.

11. The sheet supplying device according to claim 8, further comprising:

a lifting and lowering unit configured to lift and lower the sheet feed tray on which the sheets are stacked;

a detector configured to detect a thickness of a sheet conveyed to a supply target device by the suction conveyor; and a lifting and lowering controller configured to drive the lifting and lowering unit to lift and lower the sheet feed tray based on the thickness detected by the detector such that the lift air blow opening is arranged beside the stacked top sheet.

12. The sheet supplying device according to claim 8, further comprising the suction conveyor configured to suck the top sheet lifted up to the flow adjuster by way of air suction and supply the top sheet to a supply target device.

13. The sheet supplying device according to claim 8, wherein the air controller is configured to cause air to blow from the first separation air blow opening and the second separation air blow opening while causing air to blow from the lift air blow opening or while stopping the blowing of air from the lift air blow opening.

14. The sheet supplying device according to claim 8, wherein the flow adjuster extends from above the lift air blow opening and the first separation air blow opening over the edge of the top sheet of the stacked sheets and is configured to cause an air flow blown from the lift air blow opening to travel along the upper surface of the stacked top sheet.

15. The sheet supplying device according to claim 8, wherein a lower surface of the flow adjuster, an upper edge of the first separation air blow opening, an upper edge of the lift air blow opening align at a same height.

16. The sheet supplying device according to claim 15, wherein the first separation air blow opening has a shape narrower in an up-down direction and longer in a conveyance direction of the sheets than a shape of the lift air blow opening.

17. The sheet supplying device according to claim 15, wherein the flow adjuster extends from above at least the first separation air blow opening.

18. A sheet supplying device comprising:

an air blow opening configured to blow air to a side portion of an uppermost part of stacked sheets, the air blow opening including a lift air blow opening configured to blow air from a side of the uppermost part of the stacked sheets to lift the sheets, and a first separation air blow opening configured to blow air from the side of the uppermost part of the stacked sheets and a second separation air blow opening configured to blow air from a downstream side of the uppermost part of the stacked sheets in a conveyance direction, the first separation air blow opening and the second separation air blow opening configured to separate the sheets from one another by blowing of the air;

a flow adjuster extending from above the air blow opening over an edge of a top sheet of the stacked sheets and configured to cause an air flow blown from the air blow opening to travel along an upper surface of the top sheet of the stacked sheets; and an air controller configured to control execution and stopping of blowing of air from the lift air blow opening, control execution and stopping of blowing of air from the first separation air blow opening, and control execution and stopping of blowing of air from the second separation air blow opening, wherein the flow adjuster extends from above the lift air blow opening and the first separation air blow opening over the edge of the top sheet of the stacked sheets and is configured to cause an air flow blown from the lift air blow opening to travel along the upper surface of the stacked top sheet, and the air controller is further configured to:

cause air to blow from the lift air blow opening and generate the air flow along the upper surface of the stacked top sheet, after the air flow generated from the air blown from the lift air blow opening lifts the stacked top sheet to the flow adjuster, stop the blowing of air from the lift air blow opening while the top sheet is sucked by a suction conveyor, and while stopping the blowing of air from the lift air blow opening, cause air to blow from the first separation air blow opening and the second separation air blow opening to between the top sheet lifted up to the flow adjuster and a second top sheet to separate the top sheet and the second top sheet from each other.

* * * * *